US010268134B2

(12) United States Patent
Hori

(10) Patent No.: US 10,268,134 B2
(45) Date of Patent: Apr. 23, 2019

(54) CHARGING DEVICE, IMAGE FORMING UNIT COMPRISING THE SAME, AND IMAGE FORMING APPARATUS COMPRISING THE SAME

(71) Applicant: Sharp Kabushiki Kaisha, Osaka (JP)

(72) Inventor: Takashi Hori, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 0 days.

(21) Appl. No.: 15/252,419

(22) Filed: Aug. 31, 2016

(65) Prior Publication Data

US 2017/0068180 A1 Mar. 9, 2017

(30) Foreign Application Priority Data

Sep. 9, 2015 (JP) ..... 2015-177388

(51) Int. Cl.
*G03G 15/02* (2006.01)

(52) U.S. Cl.
CPC ..... *G03G 15/0258* (2013.01); *G03G 15/0291* (2013.01)

(58) Field of Classification Search
CPC ..... G03G 15/02; G03G 15/0291; H01T 19/04
See application file for complete search history.

(56) References Cited

U.S. PATENT DOCUMENTS

| | | | | |
|---|---|---|---|---|
| 7,653,325 | B2 | 1/2010 | Tomiyori | |
| 2007/0212105 | A1* | 9/2007 | Azumi | G03G 15/0258 399/100 |
| 2010/0201738 | A1* | 8/2010 | Yamaguchi | B41J 2/16535 347/31 |

FOREIGN PATENT DOCUMENTS

| | | | |
|---|---|---|---|
| CN | 101097424 | A | 1/2008 |
| JP | 2010-191264 | A | 9/2010 |
| JP | 2014-182162 | A | 9/2014 |

* cited by examiner

*Primary Examiner* — Noam Reisner
(74) *Attorney, Agent, or Firm* — Renner Otto Boisselle & Sklar, LLP

(57) ABSTRACT

To provide a charging device that allows a discharging electrode to be cleaned without damaging a protruding portion at an end portion of the discharging electrode. The device is provided with: a discharging electrode including a plurality of protruding portions arranged along a predetermined direction, the discharging electrode discharging electricity from at least part of the protruding portions; a cleaner for cleaning at least some protruding portions included in the plurality of protruding portions; a cleaner conveyance mechanism for conveying the cleaner along the predetermined direction for performing the cleaning, such that the cleaner interferes with at least some protruding portions included in the plurality of protruding portions; and a cleaner height adjustment mechanism for adjusting a height of the cleaner in a vicinity of the protruding portion where the cleaner reaches at first.

18 Claims, 25 Drawing Sheets

CHARGING DEVICE, IMAGE FORMING UNIT COMPRISING THE SAME, AND IMAGE FORMING APPARATUS COMPRISING THE SAME

This application is based on and claims the benefit of priority from Japanese Patent Application No. 2015-177388, filed on 9 Sep. 2015, the content of which is incorporated herein by reference.

BACKGROUND OF THE INVENTION

Field of the Invention

The present invention relates to a charging device, an image forming unit including the charging device, and an image forming apparatus including the charging device; and in particular, the present invention relates to a charging device compatible with an electrophotographic method, an image forming unit including the charging device, and an image forming apparatus including the charging device.

Related Art

An image forming apparatus employing an electrophotographic method forms an image as follows. More specifically, first of all, a charging device charges a surface of a photosensitive drum. Subsequently, a laser beam, which is modulated in accordance with content of an image to be formed, is emitted onto the surface of the charged photosensitive drum, thereby reducing part of the charge on the surface of the photosensitive drum, and as a result, a latent image is formed on the photosensitive drum. A developing unit causes a toner to be attached onto the surface of the photosensitive drum, on which the latent image has been formed, thereby developing the latent image into a toner image on the surface of the photosensitive drum. Subsequently, the toner image formed on the surface of the photosensitive drum is transferred onto a recording medium such as paper, by way of a transfer unit. The image transferred onto the recording medium is fixed to the recording medium, by way of a fixing unit.

Here, part of the toner for forming a toner image will waft in the atmosphere around the periphery of the photosensitive drum, and as a result, part of the periphery of the photosensitive drum may be contaminated with such toner. In particular, a high voltage is applied to a discharging electrode provided to the charging device for charging the surface of the photosensitive drum, and the discharging electrode performs corona discharge towards the surface of the photosensitive drum. In such a circumstance, contaminant such as carbon compounds and nitrogen oxides (NOx) will attach to the discharging electrode. When such contaminant is attached to the discharging electrode in this manner, the charging device may not function sufficiently, and the photosensitive drum may be hindered from being sufficiently uniformly charged.

In line with this, inventions for removing contaminant attached to a discharging electrode have been made. For example, Patent Document 1 discloses a corona discharge device, which is provided with: a corona electrode formed in a serrated shape; a roller for removing corona products attached to the corona electrode; and a retaining portion for moving the roller along a longitudinal direction of the corona electrode; in which the corona electrode supports the roller so as to be displaceable in a direction away from the retaining portion. In addition, the corona discharge device, which is further provided with a biasing member for biasing the roller towards the corona electrode side, is also disclosed.

Patent Document 1: Japanese Unexamined Patent Application, Publication No. 2010-191264

However, in a conventional scorotron charging device, for example, a discharging electrode being a corona electrode is shaped like a saw blade provided with a plurality of protruding portions. Therefore, the roller being biased towards the discharging electrode side will sequentially clean the protruding portions, from the protruding portion at one end portion to the protruding portion at the other end portion, while applying a pressure thereto. Once the roller has travelled at least a predetermined distance from the end portion of the discharging electrode, the roller maintains a height at a predetermined level or higher in a vicinity of the upper end of the plurality of protruding portions. In contrast, until the roller reaches the front end of the discharging electrode, the roller is at the level in a vicinity of the lower end of the protruding portions of the discharging electrode; therefore, the roller may directly hit the base of the protruding portion in the vicinity of the front end of the discharging electrode, and as a result, the protruding portion at the front end may be damaged.

SUMMARY OF THE INVENTION

Against such a background, the present invention aims to provide a charging device, an image forming unit including the charging device, and an image forming apparatus including the charging device, all of which make it possible to clean a discharging electrode without any risk of damaging a protruding portion at an end portion of the discharging electrode.

The present invention provides a charging device, which is provided with: a discharging electrode including a plurality of protruding portions arranged along a predetermined direction, the discharging electrode discharging electricity from at least part of the protruding portions; a cleaner for cleaning at least some protruding portions included in the plurality of protruding portions; a cleaner conveyance mechanism for conveying the cleaner along the predetermined direction for performing the cleaning, such that the cleaner interferes with at least some protruding portions included in the plurality of protruding portions; and a cleaner height adjustment mechanism for adjusting a height of the cleaner in a vicinity of the protruding portion where the cleaner reaches at first.

According to the present invention, a discharging electrode can be cleaned without any risk of damaging a protruding portion at an end portion of the discharging electrode.

DETAILED DESCRIPTION OF THE INVENTION

An image forming apparatus according to an embodiment of the present invention is described with reference to the drawings. The image forming apparatus according to the present embodiment is a copy machine, a printer, a facsimile, or a multifunction peripheral thereof; and an electrophotographic laser beam printer capable of forming an image (hereinafter simply referred to as "printer") is described as an example of the image forming apparatus.

First Embodiment

Figure 1:
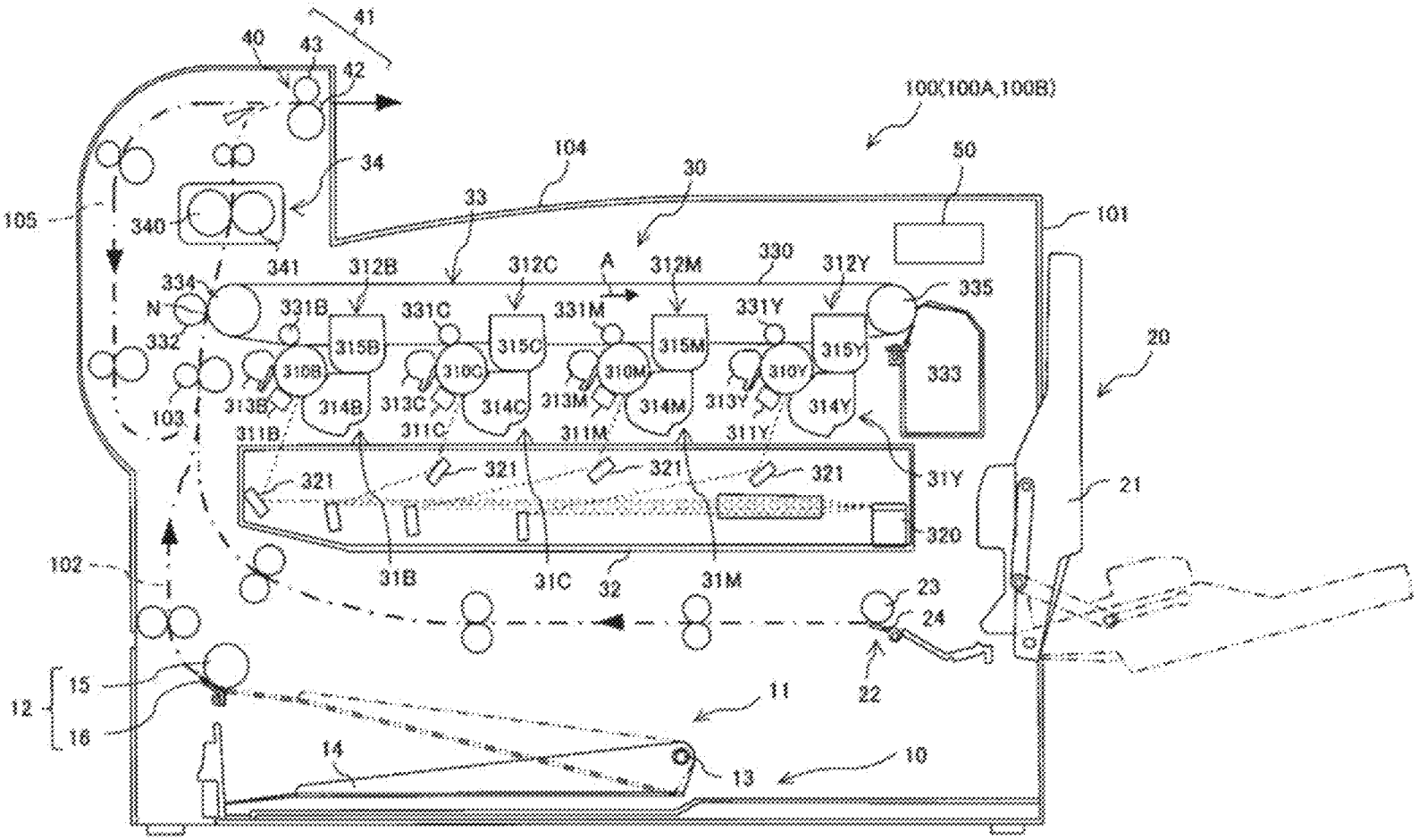
FIG. 1 is a conceptual diagram illustrating an image forming apparatus according to an embodiment of the present invention.
Figure 2:
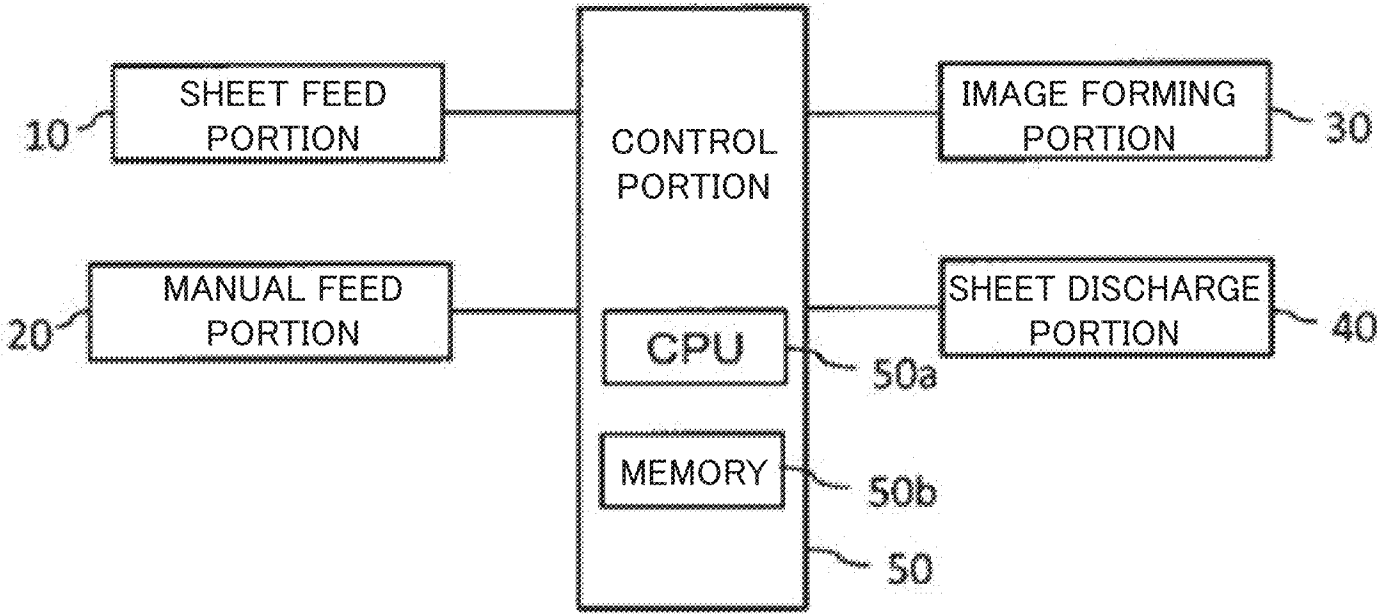
FIG. 2 is a block diagram illustrating a configuration of a control portion and each portion controlled by the control portion of the image forming apparatus according to the embodiment of the present invention.

A printer 100 according to a first embodiment is described with reference to FIGS. 1 and 2. FIG. 1 is a cross-sectional view schematically illustrating the printer 100 according to the first embodiment of the present invention. FIG. 2 is a block diagram diagrammatically illustrating the functions of the printer 100 according to the first embodiment.

As illustrated in FIG. 1, the printer 100 is provided with: a sheet feed portion 10 for feeding a sheet; a manual feed portion 20 for allowing a sheet to be manually fed; an image forming portion 30 for forming an image on the sheet fed from the sheet feed portion 10 or the manual feed portion 20; a sheet discharge portion 40 for externally discharging the sheet with the image formed thereon; and a control portion 50 for controlling these portions.

The sheet feed portion 10 is provided with: a feed sheet load portion 11 for loading/storing sheets; and a separation feed portion 12 for separately feeding the sheets, loaded in the feed sheet load portion 11, on a sheet-by-sheet basis. The feed sheet load portion 11 is provided with an intermediate plate 14 that pivots on a pivot axis 13; and when feeding a sheet, the intermediate plate 14 pivots, and lifts the sheet upwards (the state illustrated with the two-dot chain line in FIG. 1). The separation feed portion 12 is provided with: a pickup roller 15 for feeding a sheet lifted by the intermediate plate 14; and a separation pad 16 in pressure-contact with the pickup roller 15.

The manual feed portion 20 is provided with: a manual feed tray 21 capable of loading sheets; and a separation feed portion 22 capable of separately feeding the sheets, loaded in the manual feed tray 21, on a sheet-by-sheet basis. The manual feed tray 21 is pivotally supported by a printer main body 101, and when sheets are manually fed, the sheets can be loaded by pivoting the manual feed tray 21 (the state illustrated with the two-dot chain line in FIG. 1). The separation feed portion 22 is provided with: a feed roller 23 for feeding a sheet loaded in the manual feed tray 21; and a separation pad 24 in pressure-contact with the feed roller 23.

The image forming portion 30 is provided with: four process cartridges (image forming units) 31Y to 31B for forming images in yellow (Y), magenta (M), cyan (C), and black (B), respectively; an exposure device (also referred to as "exposing unit") 32 for exposing surfaces of photosensitive drums 310Y to 310B, respectively (to be described later); a transfer portion (transferring means) 33 for transferring toner images formed on the surfaces of the photosensitive drums 310Y to 310B, respectively, to a sheet; and a fixing portion (fixing means) 34 for fixing an unfixed toner image transferred to a sheet. In the first embodiment, the image forming portion 30 is set so as to be capable of forming an image at a high process speed on the order of 320 to 375 mm/s.

Each of the four process cartridges 31Y to 31B is removably attached to the printer main body 101, and is replaceable. Note that the four process cartridges 31Y to 31B have the same configuration except for forming an image in different colors; therefore, the configuration of the process cartridge 31Y for forming a yellow (Y) image is described herein, thereby omitting descriptions of the other process cartridges 31M to 31B. Further, the alphabets (Y, M, C and B) suffixed to the reference numbers represent the respective colors (yellow, magenta, cyan and black).

The process cartridge 31Y is provided with: a photosensitive drum 310Y as an image carrier; a scorotron charging device (hereinafter simply referred to as "charging device" or "charging unit") 311Y for charging the photosensitive drum 310Y; a developing device (also referred to as "developing unit") 312Y for developing an electrostatic latent image into a toner image, the electrostatic latent image formed on the photosensitive drum 310Y by virtue of variation in the charge distribution; and a cleaner unit 313Y for removing toner remaining on the surface of the photosensitive drum 310Y after transferring a toner image to a recording medium, a transfer device or the like. Note that a latent image is an arbitrary image; and even if the transfer is not performed, toner will be removed in preparation for the subsequent image formation.

The photosensitive drum 310Y is formed in a substantially cylindrical shape, and is supported by driving means (not illustrated) such that the photosensitive drum 310Y can be rotationally driven around the axis line. Further, the photosensitive drum 310Y has a conductive substrate and a photosensitive layer formed on the surface of the conductive substrate. The conductive substrate can take a shape such as a cylindrical or pillar shape or a thin film, and is formed in a cylindrical shape in the first embodiment. The photosensitive layer is formed by laminating a charge generation layer having a charge generation material and a charge transport layer having a charge transport material; and it is preferable that an undercoating layer is provided between the charge generation layer and the charge transport layer. The charging device 311Y faces the surface of the photosensitive drum 310Y, and is arranged along the longitudinal direction of the photosensitive drum 310Y. Note that the charging device 311Y will be described later in detail.

The developing device 312Y is arranged so as to face the surface of the photosensitive drum 310Y, at a downstream side of the charging device 311Y in the rotational direction of the photosensitive drum 310Y; and the developing device 312Y is provided with: a developing device main body 314Y for developing, with toner, an electrostatic latent image formed on the surface of the photosensitive drum 310Y; and a toner cartridge 315Y for supplying toner to the developing device main body 314Y. The toner cartridge 315Y is removably attached to the developing device main body 314Y; and when the toner cartridge 315Y runs out of the toner stored, the toner cartridge 315Y can be removed from the developing device main body 314Y, and can be replaced. The cleaner unit 313Y is arranged to a downstream side of the developing device 312Y in the rotational direction of the photosensitive drum 310Y.

The exposure device 32 is provided with: a light source 320 for emitting a laser beam; and a plurality of mirrors 321, etc. for guiding the laser beam to the surfaces of the photosensitive drums 310Y to 310B.

The transfer portion 33 is provided with: a primary transfer belt 330 for carrying the toner images formed on the photosensitive drums 310Y to 310B; primary transfer rollers 331Y to 331B for primarily transferring the toner images formed on the photosensitive drums 310Y to 310B, respectively, to the primary transfer belt 330; a secondary transfer roller 332 for secondarily transferring the toner image carried by the primary transfer belt 330 to a sheet; and a cleaner unit 333 for removing the toner remaining on the primary transfer belt 330. The primary transfer belt 330 is stretched between a driving roller 334 and a driven roller 335, and is pressed against the photosensitive drums 310Y to 310B by way of the primary transfer rollers 331Y to 331B. The primary transfer belt 330 is nipped between the secondary transfer roller 332 and the driving roller 334; and at a nip portion N, a toner image carried by the primary transfer belt 330 is transferred to a sheet.

The fixing portion 34 is provided with: a heating roller 340 for heating a sheet; and a pressing roller 341 in pressure-contact with the heating roller 340. The sheet discharge portion 40 is provided with a pair of discharge rollers 41, in which the pair of discharge rollers 41 is provided with: a discharge roller 42 capable of reversible rotation; and a driven roller 43 that rotates as driven by the discharge roller 42.

As illustrated in FIG. 2, the control portion 50 is provided with: a CPU 50*a* for controlling the operations of the sheet feed portion 10, the manual feed portion 20, the image forming portion 30 and the sheet discharge portion 40; and memory 50*b* for storing various programs, variety of information, etc. By use of these, the control portion 50 integrates and controls the operations of the sheet feed portion 10, the manual feed portion 20, the image forming portion 30 and the sheet discharge portion 40, and causes an image to be formed on a sheet.

Next, descriptions are provided for an image forming operation of the printer 100 (image forming control by the control portion 50) configured as described above. In the first embodiment, descriptions are provided by way of an image forming operation for forming an image on a sheet S loaded in the feed sheet load portion 11, based on image information that is input from an external PC.

When image information is input from the external PC into the printer 100, the exposure device 32 emits a laser beam towards the photosensitive drums 310Y to 310B, based on the input image information. At this time, the photosensitive drums 310Y to 310B have been electrically charged in advance by the charging devices 311Y to 311B, respectively; and upon being irradiated with a laser beam, an electrostatic latent image is formed on the photosensitive drums 310Y to 310B. Subsequently, an electrostatic latent image is developed by the developing devices 312Y to 312B; and toner images in yellow (Y), magenta (M), cyan (C) and black (B) are formed on the photosensitive drums 310Y to 310B, respectively. By way of the primary transfer rollers 331Y to 331B, the toner images in the respective colors formed on the photosensitive drums 310Y to 310B are sequentially transferred in a superimposed manner to the primary transfer belt 330 rotating in the direction of an arrow A; and the toner image having being transferred in a superimposed manner (toner image in full color) is conveyed to the nip portion N by way of the primary transfer belt 330.

In parallel with the above-mentioned image forming operation, the sheets loaded in the feed sheet load portion 11 are fed, on a sheet-by-sheet basis, to the sheet conveyance path 102 by way of the separation feed portion 12. In addition, skew is corrected by way of a pair of resisting rollers 103 downstream of the sheet conveyance path 102; a sheet is conveyed to the nip portion N at a predetermined conveyance timing; and at the nip portion N, the toner image on the primary transfer belt 330 is transferred to the sheet. The sheet with the toner image transferred thereon is heated and pressurized in the fixing portion 34 so as to fuse and fix the toner image, and is externally discharged by way of the pair of discharge rollers 41. The sheet externally discharged is loaded onto a discharged-sheet loading portion 104 provided on the top surface of the printer main body 101.

Note that, when an image is formed on both sides (first and second faces) of the sheet, before the sheet having an image formed on the first face (front face) is discharged to the discharged-sheet loading portion 104, the discharge roller 42 is reversed, and the sheet is conveyed to a double-side conveyance path 105, and is re-conveyed to the image forming portion 30 through the double-side conveyance path 105. Further, similar to the first face, an image is formed on the second face (rear face), and the sheet is externally discharged.

Next, the charging device according to the first embodiment of the present invention is described in detail. Although the charging device includes the charging devices 311Y, 311M, 311C and 311B respectively corresponding to the four colors, the charging device 311Y is described herein as representing the charging device 311.

Figure 3:
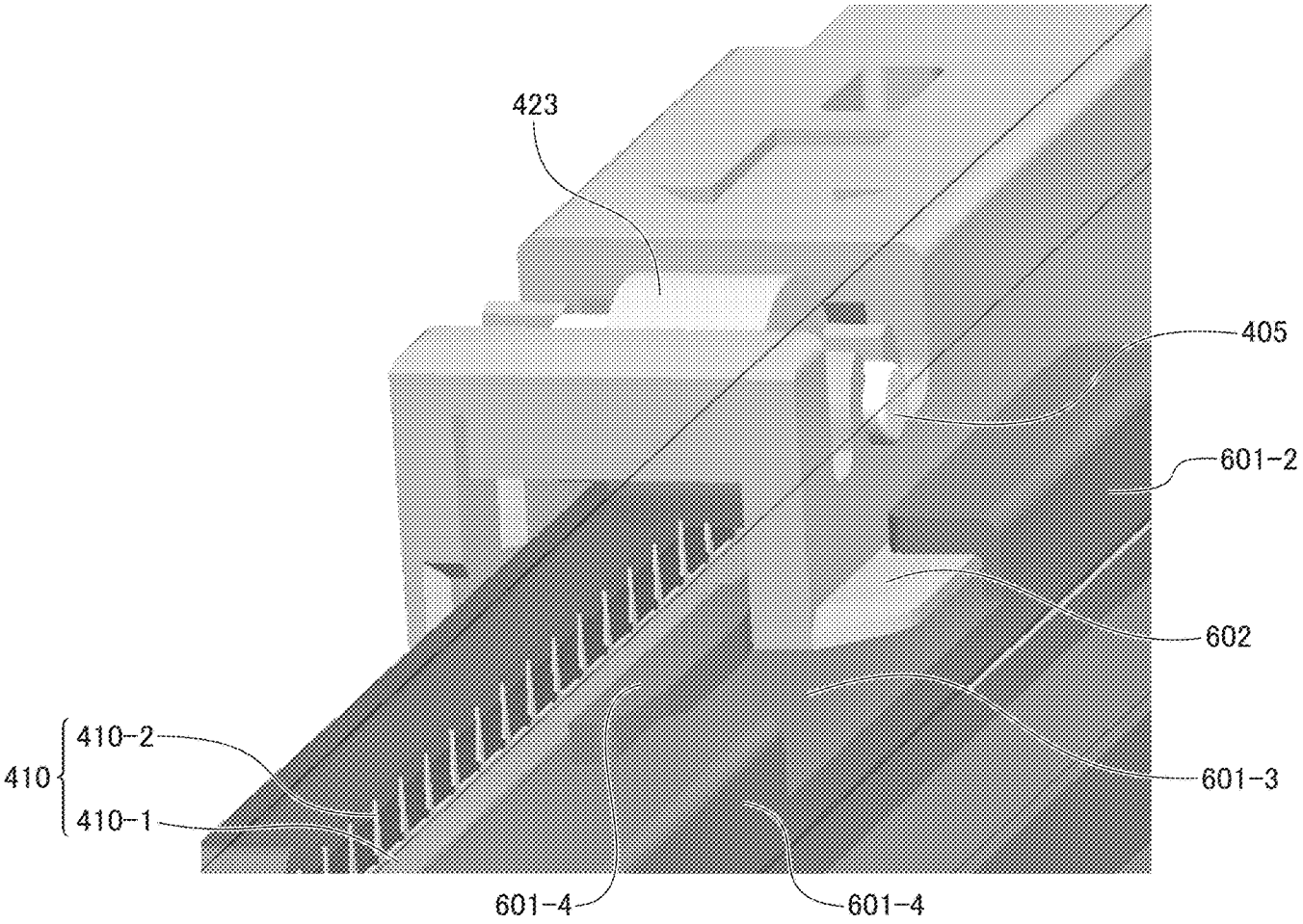
FIG. 3 is a perspective view illustrating a vicinity of a tip portion, etc. of a main charger (hereinafter referred to as "MC") cleaner bar provided to a charging device according to the embodiment of the present invention.

With reference to FIG. 3, the charging device 311 according to the first embodiment is provided with a discharging electrode 410 having a serrated shape. The discharging electrode 410 is formed in a serrated shape so as to include: a main body portion 410-1 extending along a longitudinal direction of the charging device 411; and a plurality of protruding portions 410-2 arranged along the longitudinal direction on the upper end surface of the main body portion 410-1. When a power supply (not shown) applies a high voltage to the discharging electrode 410, corona discharge is generated, in which at least part of the plurality of protruding portions 410-2 serves as at least part of the discharging path. Charged particles such as electrons emitted by way of corona discharge from the plurality of protruding portions 410-2 will attach to the surface of the photosensitive drum; as a result, the surface of the photosensitive drum will be charged. In this sense, such a device performing corona discharge could also be referred to as a discharging device; however, this device is herein referred to as the charging device 311.

Figure 4:
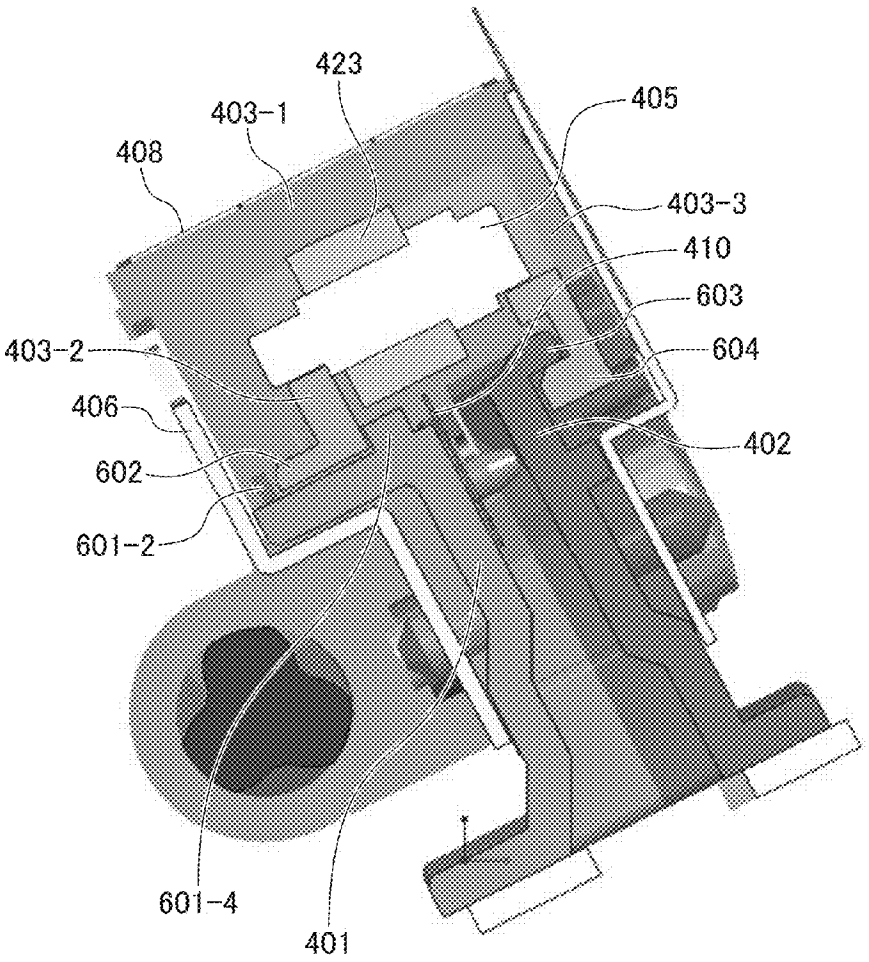
FIG. 4 is a cross-sectional view perpendicular to a longitudinal direction of the charging device according to the embodiment of the present invention.
Figure 5:
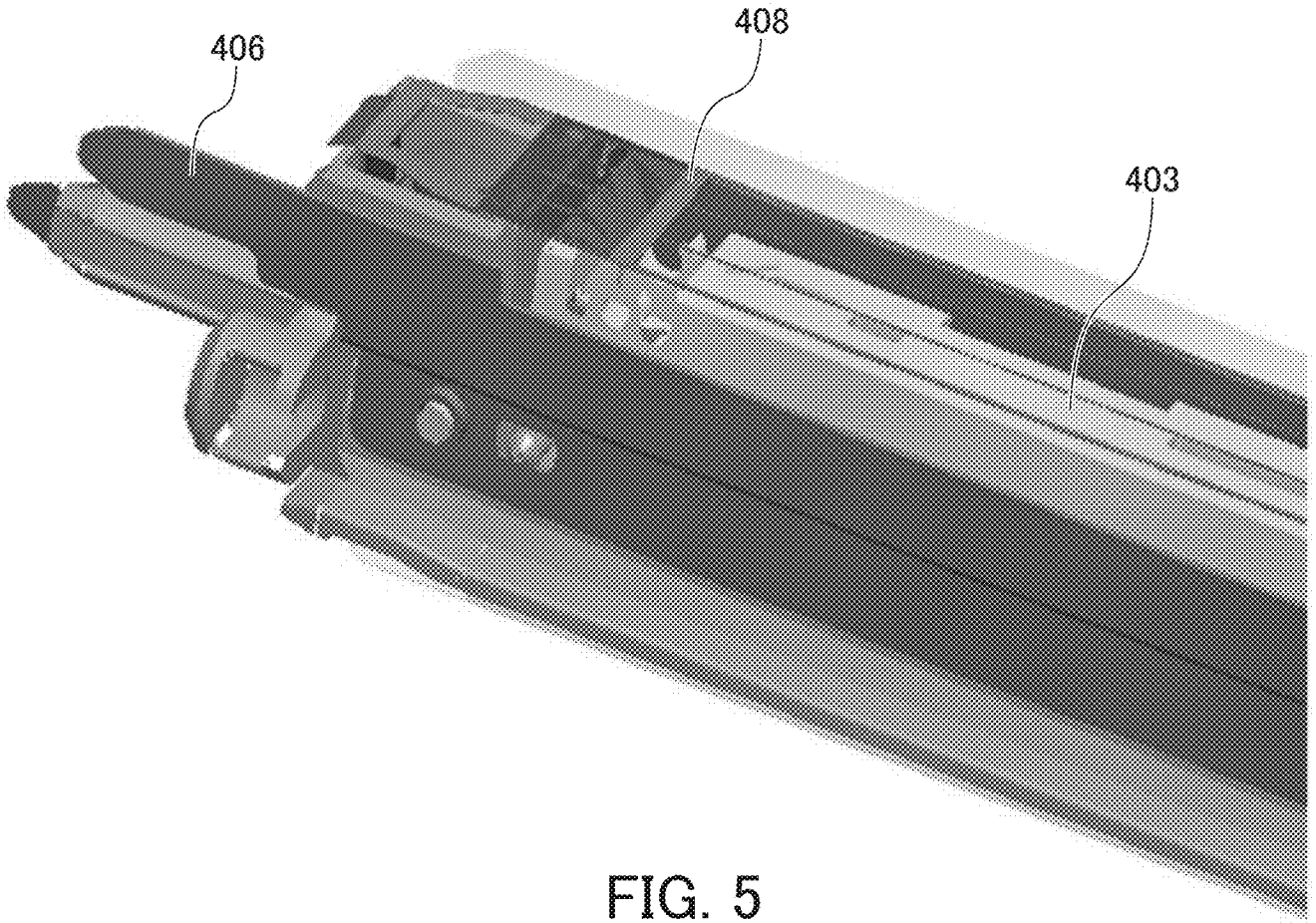
FIG. 5 is a perspective view illustrating a head portion at a far end side of the charging device according to the embodiment of the present invention.
Figure 6:
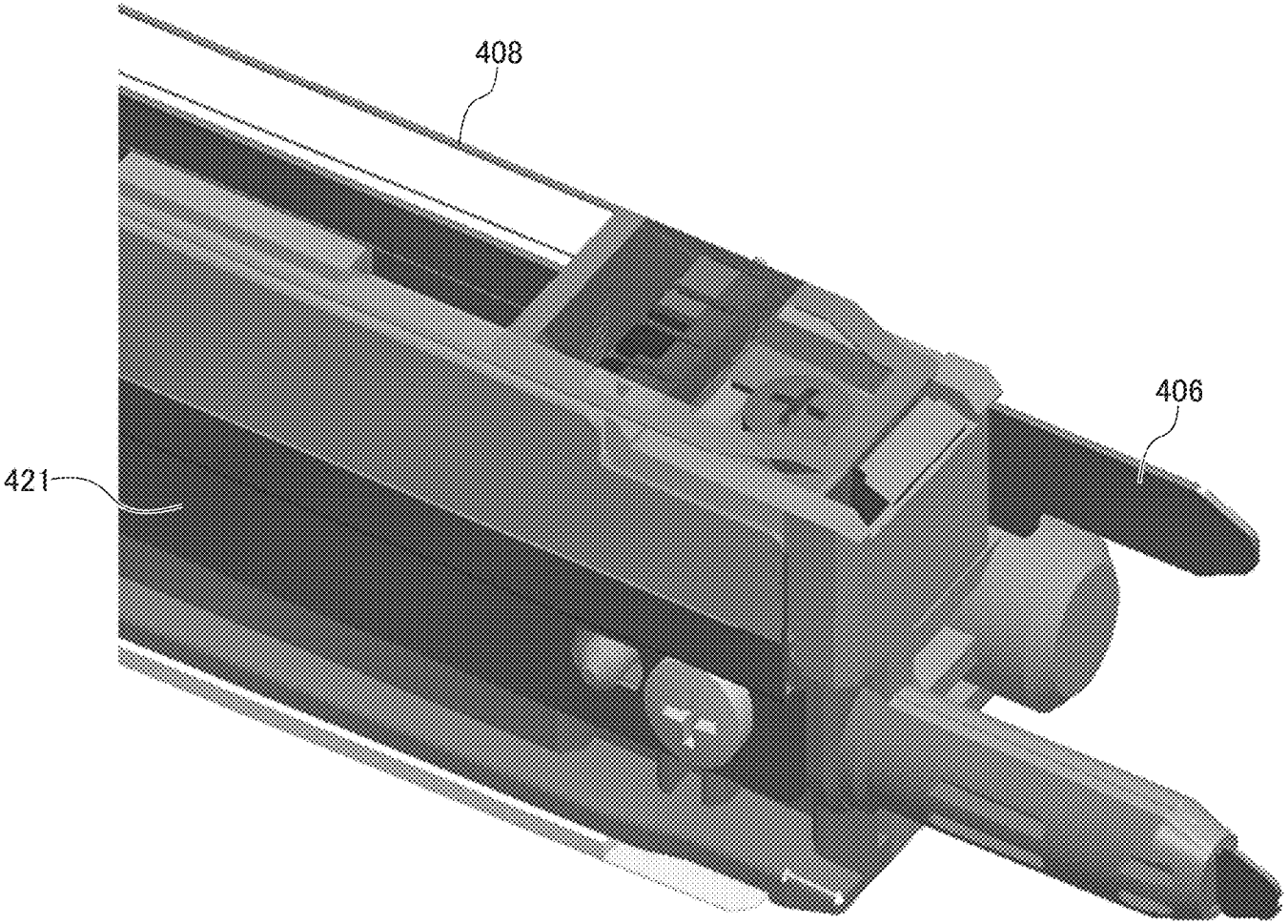
FIG. 6 is another perspective view illustrating the head portion at the far end side of the charging device according to the embodiment of the present invention.

Note that, as illustrated in FIGS. 4, 5 and 6, the charging device 311 is also provided with a grid electrode 408, a shielding case plate 406, and a shielding case plate 421; these members adjust the electric field distribution between the discharging electrode 410 and the surface of the photosensitive drum; and this adjustment allows the surface of the photosensitive drum to be uniformly charged. Although the drawings illustrate only a frame of the grid electrode 408, the grid electrode 408 is actually shaped like, for example, a grid, grill, mesh, or the like.

As illustrated in FIGS. 3 and 4, a first discharging electrode retaining portion 401 and a second discharging electrode retaining portion 402 retain the discharging electrode 410 over the entire length in the longitudinal direction.

Figure 7:
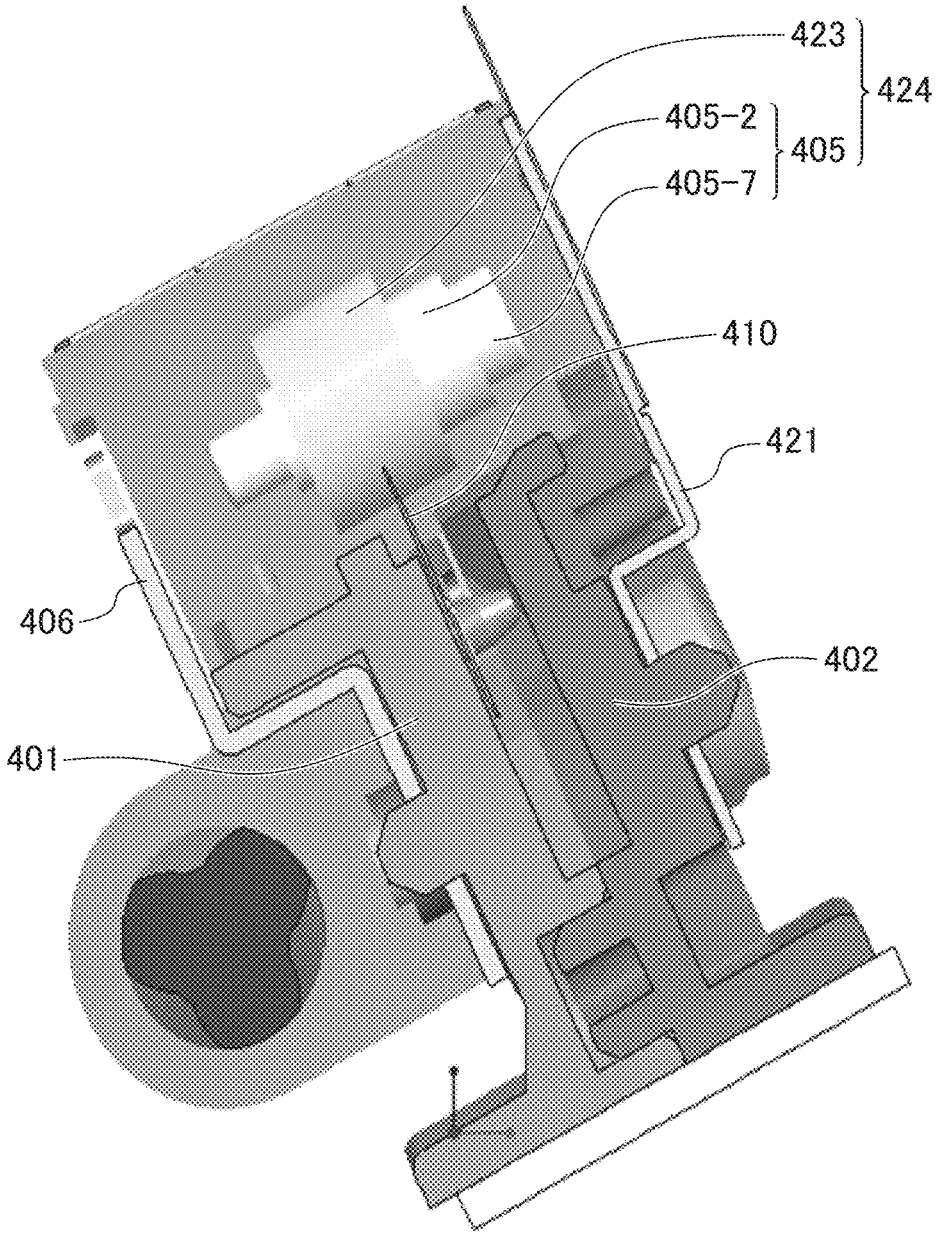
FIG. 7 is another cross-sectional view perpendicular to the longitudinal direction of the charging device according to the embodiment of the present invention.
Figure 8:
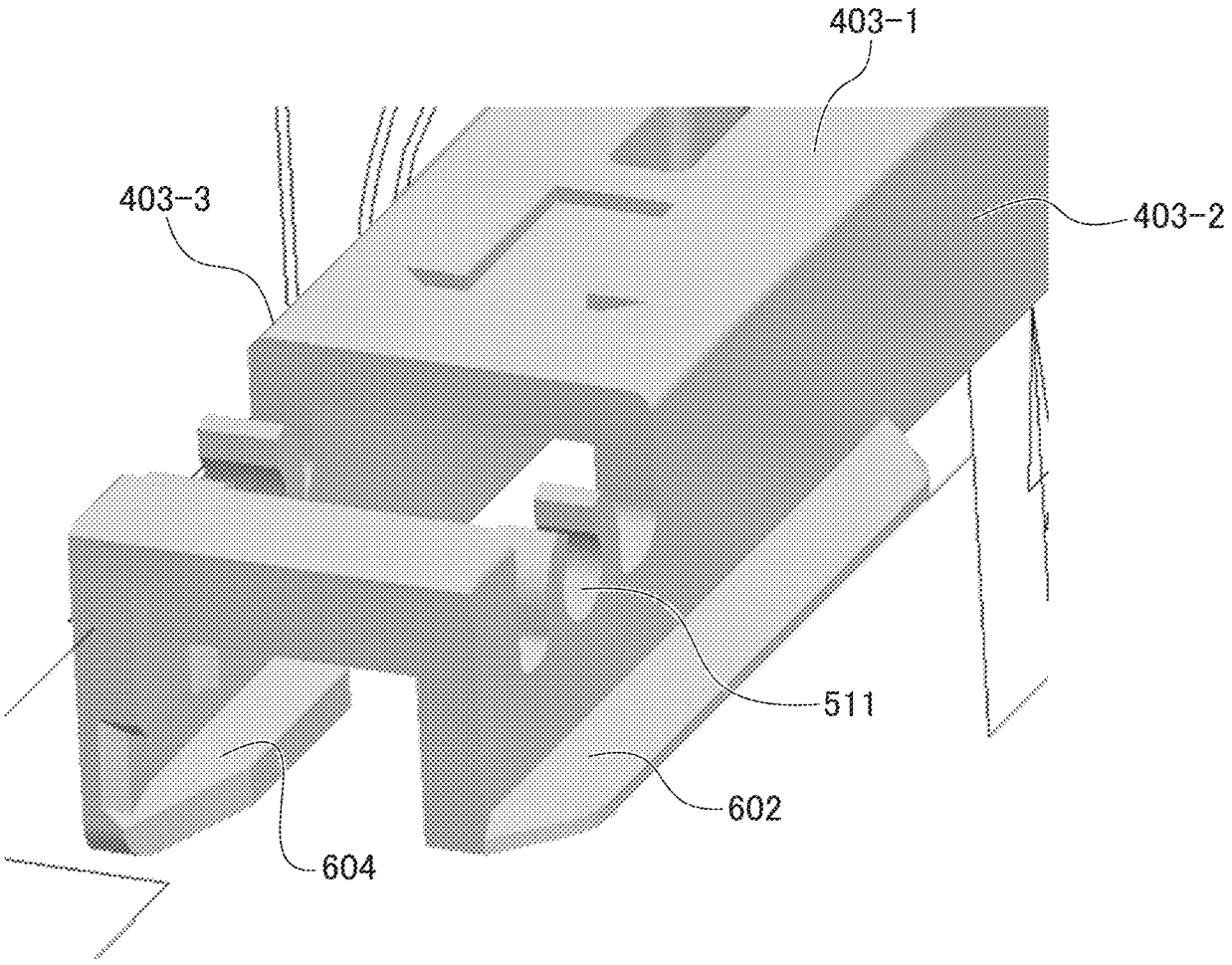
FIG. 8 is a perspective view illustrating a shape in a vicinity of a tip of the MC cleaner bar according to the embodiment of the present invention.
Figure 9:
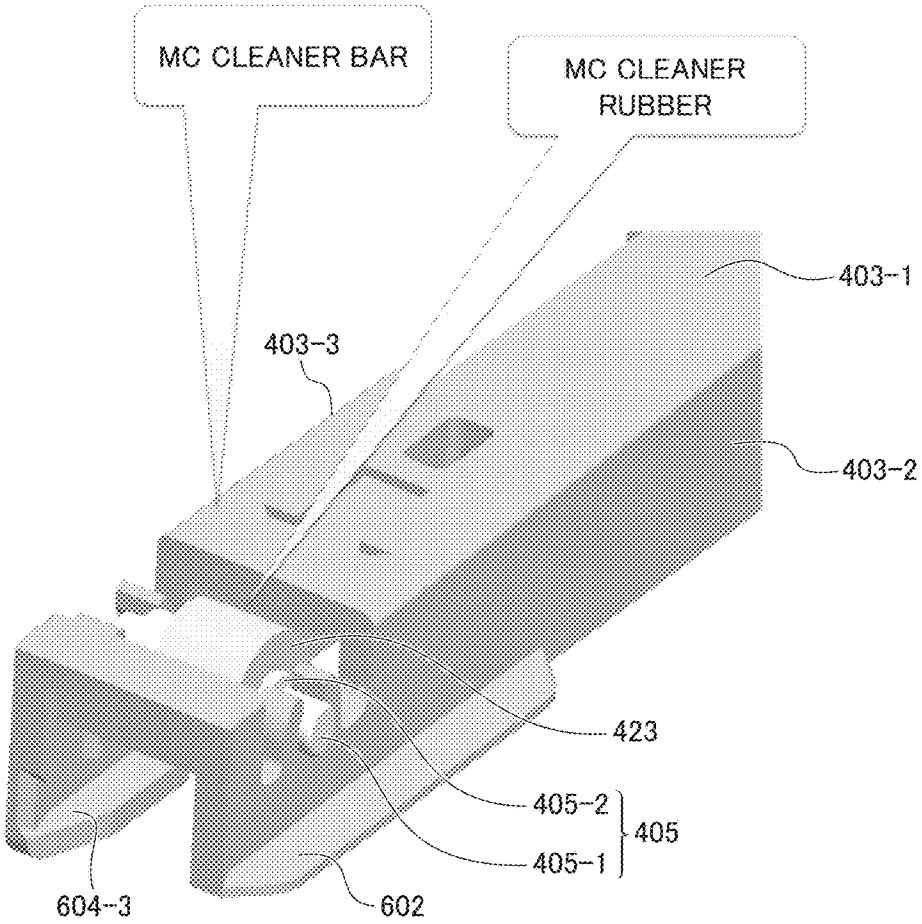
FIG. 9 is a perspective view illustrating the shape in the vicinity of the tip of the MC cleaner bar, and a shape of an MC cleaner attached thereto, according to the embodiment of the present invention.

With reference to FIGS. 3, 4 and 7, a cylindrical MC cleaner rubber 423 is attached to an outer circumference of a multistage cylindrical MC cleaner main body 405; and both of these cleaning members compose a roller-shaped MC cleaner 424. Here, as illustrated in FIG. 7, the MC cleaner main body 405 includes an MC cleaner shaft portion 405-1 and an MC cleaner wheel portion 405-2. The MC cleaner 424 is rotatably attached to a region in a vicinity of a tip portion of a MC cleaner bar 403 shaped like a long bar. Specifically, as illustrated in FIG. 8, a pair of bearings 511 is formed in a vicinity of the tip portion of the MC cleaner bar 403; and as illustrated in FIG. 9, end portions of the MC cleaner shaft portion 405-1 are rotatably inserted into the pair of bearings 511, respectively. The MC cleaner bar 403 functions as a cleaner holder for holding the MC cleaner 424.

Figure 10:
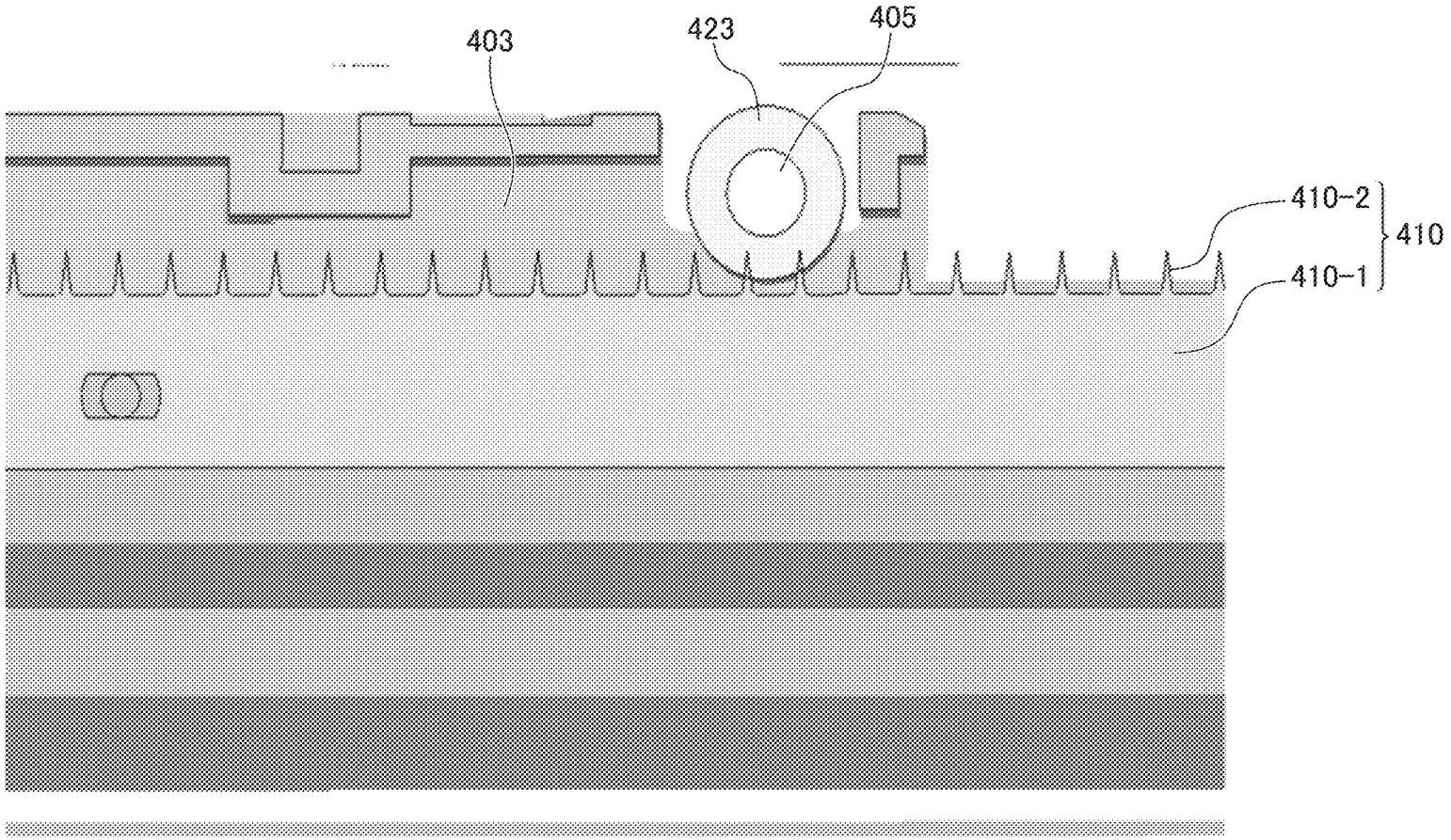
FIG. 10 is a partial cross-sectional view illustrating a vertical cross section parallel to the longitudinal direction of the charging device according to the embodiment of the present invention.
Figure 11:
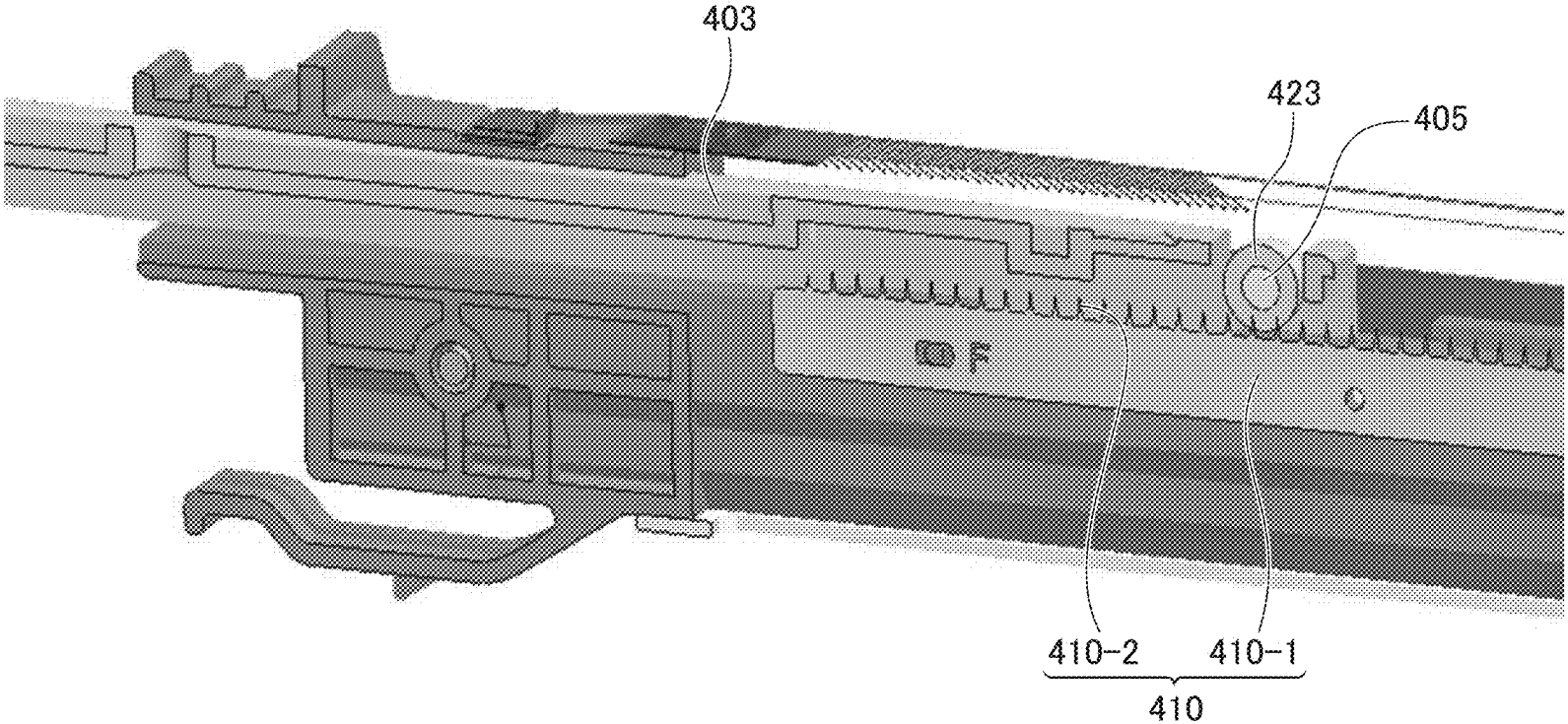
FIG. 11 is a partial perspective view illustrating the vertical cross section parallel to the longitudinal direction of the charging device according to the embodiment of the present invention.

As illustrated in FIGS. 3, 4, 7, etc., the MC cleaner rubber 423 of the MC cleaner 424 is configured to interfere with the protruding portion 410-2 of the discharging electrode 410, and one or more of the nearest protruding portions 410-2 pierce the MC cleaner rubber 423 (refer to FIGS. 10 and 11).

Figure 12:
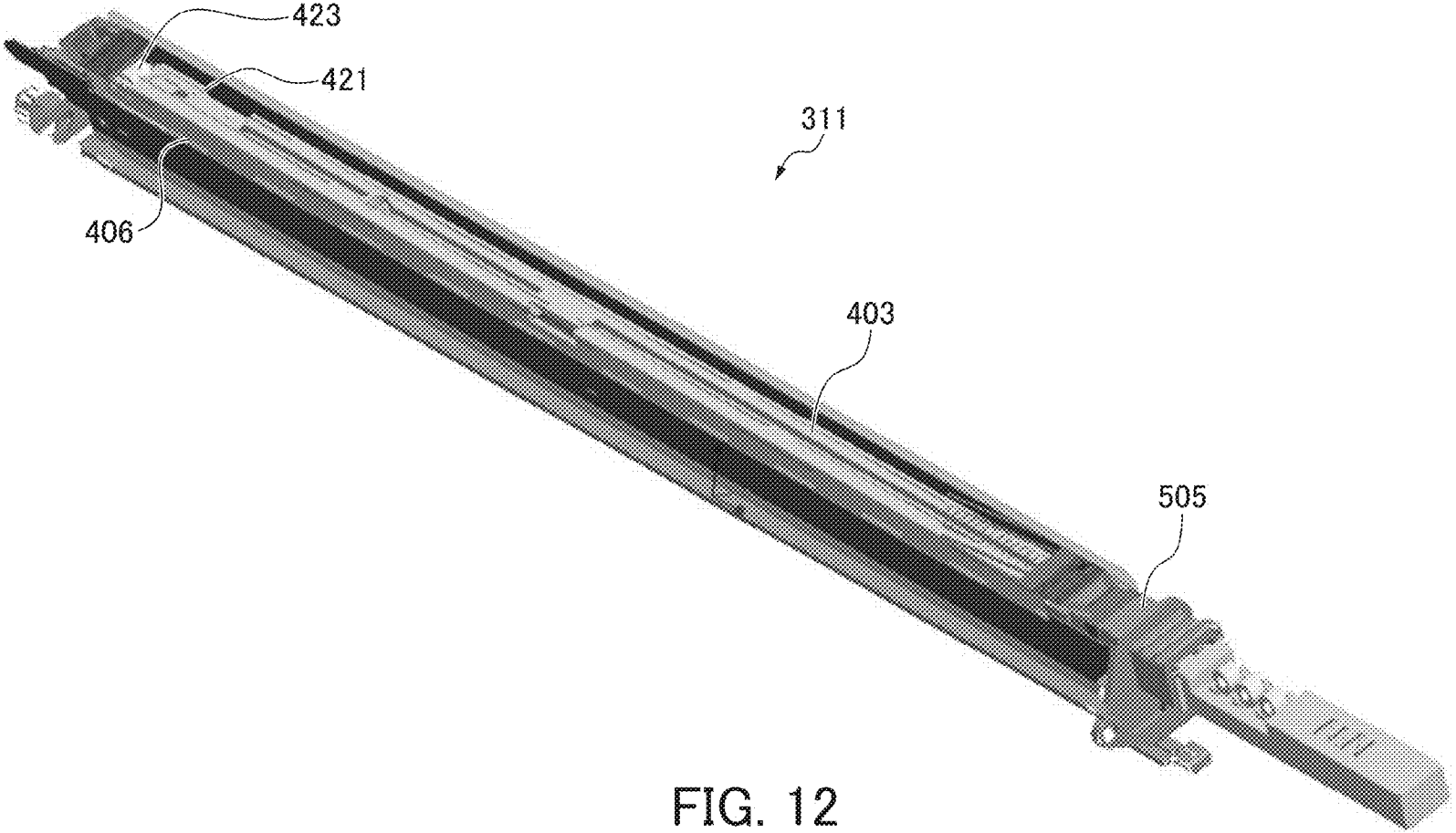
FIG. 12 is a perspective view illustrating a state where the MC cleaner bar is inserted approximately 100% into an inside of the charging device according to the embodiment of the present invention.
Figure 13:
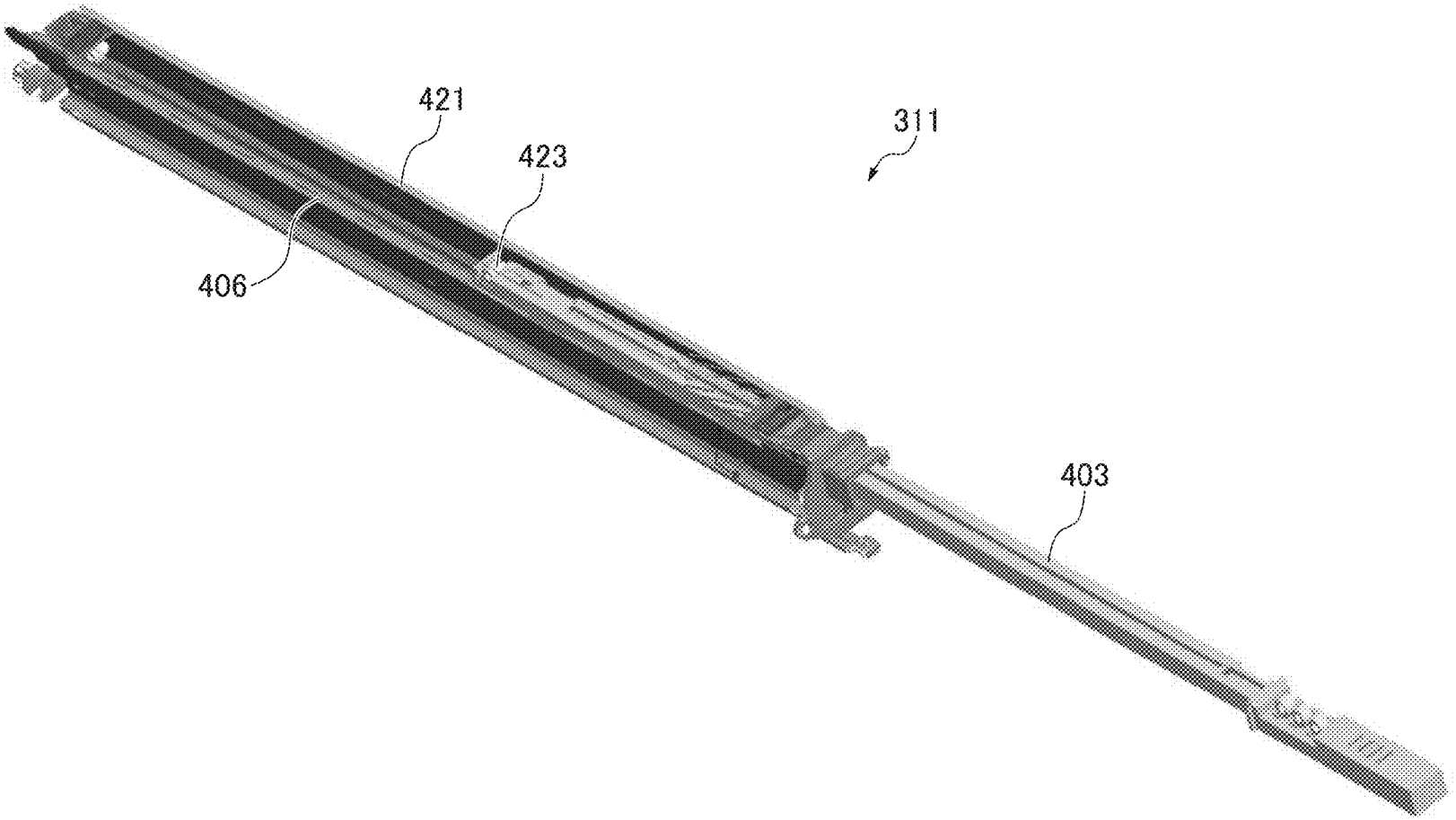
FIG. 13 is a perspective view illustrating a state where the MC cleaner bar is inserted approximately 50% into the inside of the charging device according to the embodiment of the present invention, as viewed from the same viewpoint as FIG. 12.
Figure 14:
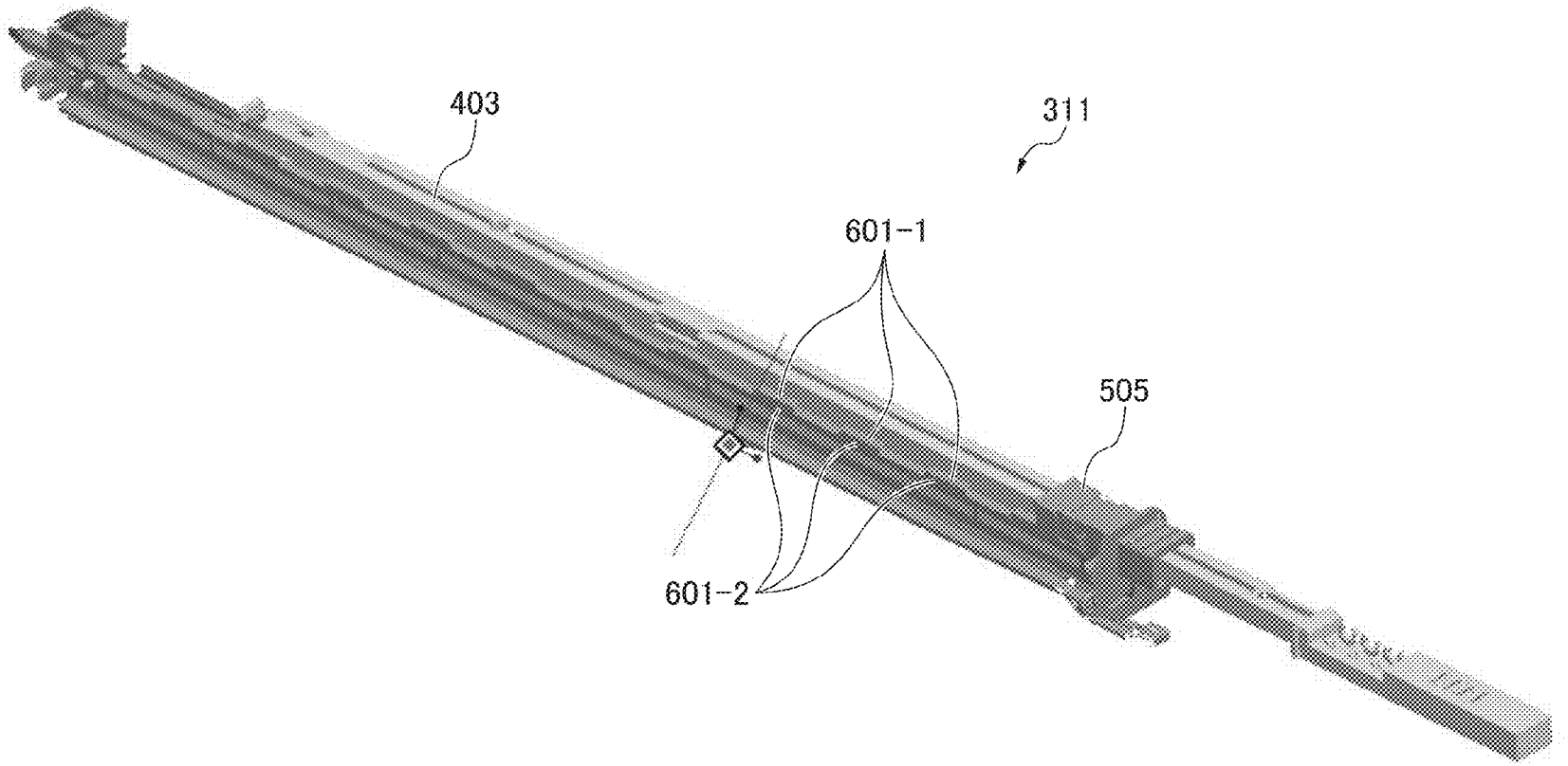
FIG. 14 is a perspective view illustrating a state where the MC cleaner bar is inserted approximately 80% into the inside of the charging device according to the embodiment of the present invention, as viewed from the same viewpoint as FIG. 12.

As illustrated in FIGS. 12, 13 and 14, the MC cleaner bar 403 has an entire length approximately equal to the entire length of the charging device 311 plus a length of a grip portion, and can be inserted, through a hollow entrance frame portion 505 as an entrance at one end side (front edge side) of the charging device 311, until reaching another end side (back edge side) of the charging device 311. Here, the entrance frame portion 505 and the MC cleaner bar 403 compose a slide rail. FIG. 13 illustrates a state where approximately a half of the MC cleaner bar 403 other than the grip portion is inserted into the charging device 311. FIG. 14 illustrates a state where approximately 80% of the MC cleaner bar 403 other than the grip portion is inserted into the charging device 311. FIG. 12 illustrates a state where the entirety of the MC cleaner bar 403 other than the grip portion is inserted into the charging device 311. As will be described later, when viewed in a travelling direction of the MC cleaner bar 403, moving-side rails 602 and 604 are formed to both of the right and left sides, and fixed-side rails 601 are 603 are formed to the first discharging electrode retaining portion 401 and the second discharging electrode retaining portion 402, respectively. The first moving-side rail 602 formed to the left side in the travelling direction of the MC cleaner bar 403, and the first fixed-side rail 601 formed to the first discharging electrode retaining portion 401, compose a first slide rail. Similarly, the second moving-side rail 604 formed to the right side in the travelling direction of the MC cleaner bar 403, and the second fixed-side rail 603 formed to the second discharging electrode retaining portion 402, compose a second slide rail. By use of the first slide rail and the second slide rail, the MC cleaner bar 403 can be inserted and removed along the longitudinal direction of the charging device 311.

As already described above, one or more of the nearest protruding portions 410-2 pierce the MC cleaner rubber 423; however, for example, when a user catches the grip of the MC cleaner bar 403, inserts the MC cleaner bar 403 into the entrance frame portion 505, and pushes it forward to the back of the charging device 311, the MC cleaner 424 will advance, while rotating, to the back of the charging device 311, while the plurality of protruding portions 410-2 pierce the MC cleaner rubber 423 one after another. As the result of the protruding portions 410-2 piercing the MC cleaner rubber 423, contaminant attached to the protruding portions 410-2 is removed therefrom, and when the protruding portions 410-2 have left the MC cleaner rubber 423, the protruding portions 410-2 will be in a cleaned state being free from the contaminant.

Next, the aforementioned slide rail is described in further detail.

Figure 15:
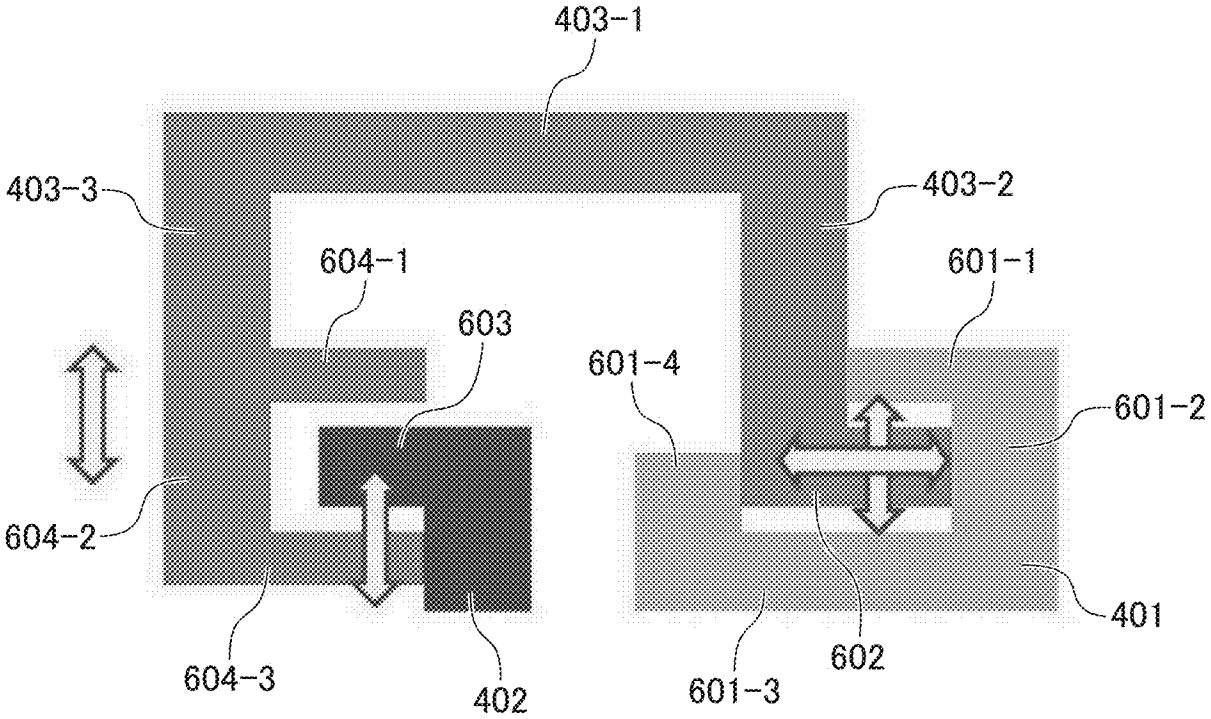
FIG. 15 is a schematic cross-sectional view perpendicular to the longitudinal direction of the charging device according to the embodiment of the present invention.
Figure 16:
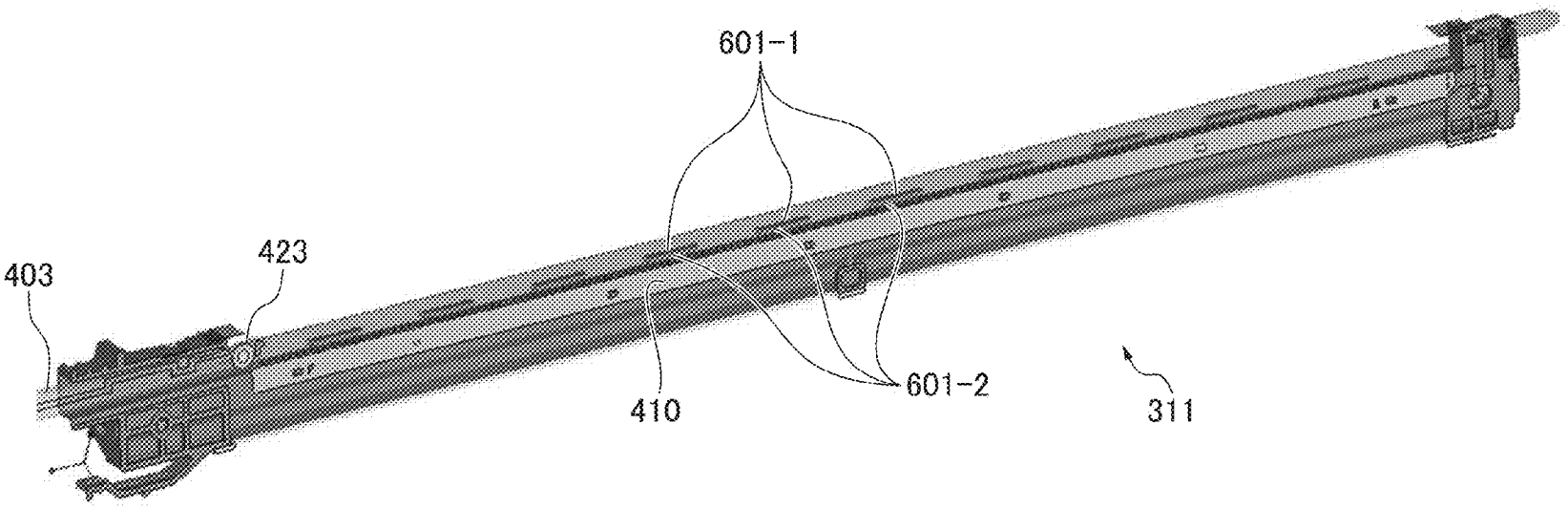
FIG. 16 is a perspective view illustrating a state where the MC cleaner bar is scarcely inserted into the inside of the charging device according to the embodiment of the present invention, as viewed from a viewpoint different from FIG. 12.
Figure 17:
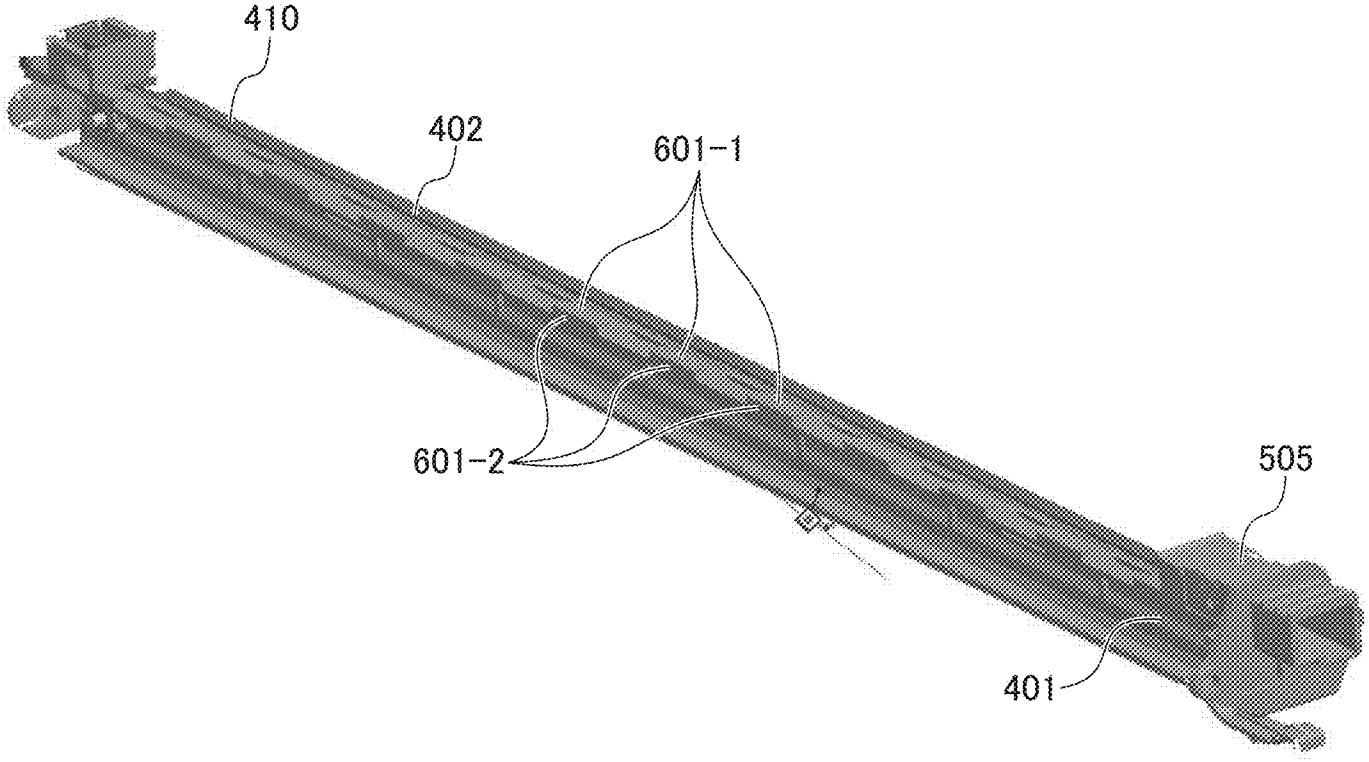
FIG. 17 is a perspective view illustrating a first discharging electrode retaining portion, a second discharging electrode retaining portion, a frame portion, etc. of the charging device according to the embodiment of the present invention, as viewed from the same viewpoint as FIG. 12.

FIG. 15 is a schematic diagram for illustrating a configuration of the slide rail, and is a schematic cross-sectional view, in which the MC cleaner bar 403 as being inserted into the charging device 311 is viewed in a direction from the insertion tip towards the insertion base. Therefore, the right side of FIG. 15 is the left side in the travelling direction, and the left side of FIG. 15 is the right side in the travelling direction.

Figure 18:
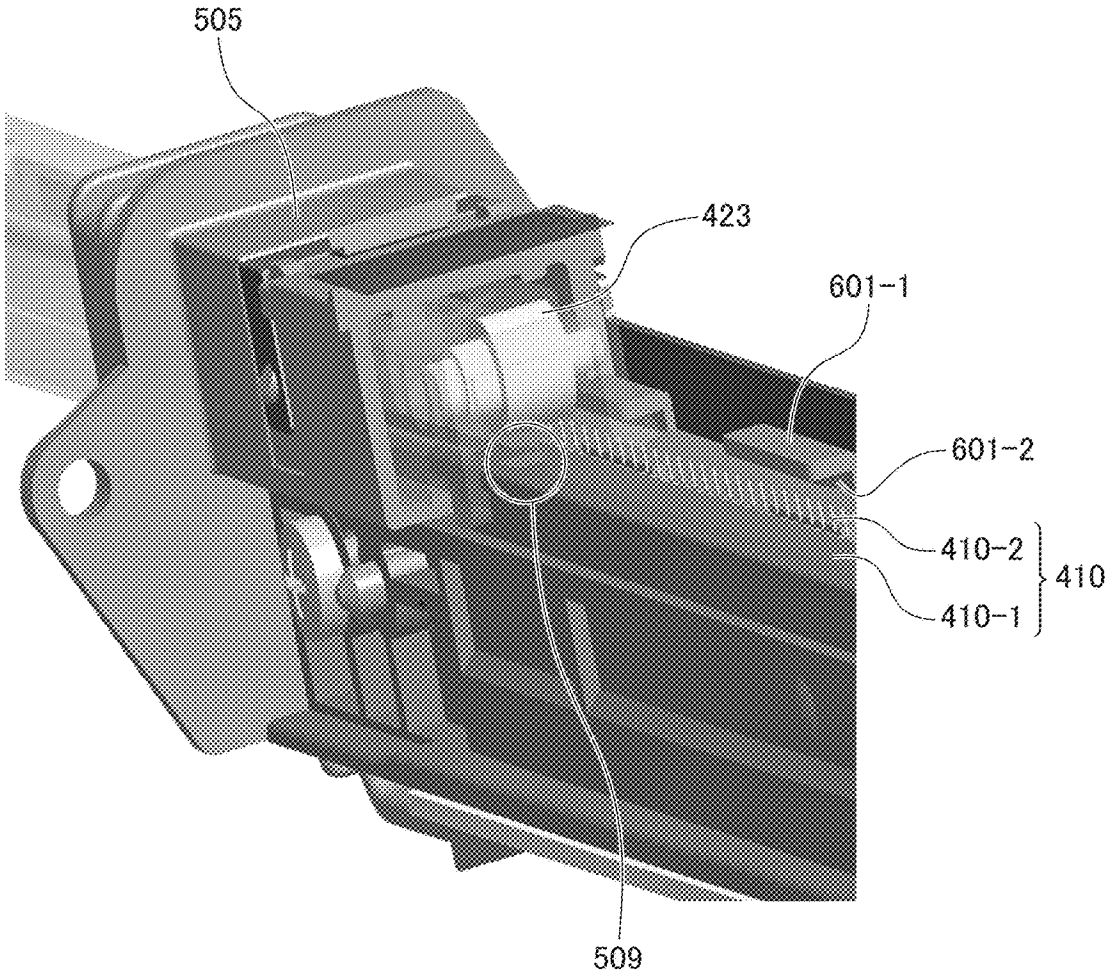
FIG. 18 is a perspective view illustrating an aspect immediately before the MC cleaner enters the discharging electrode, in the charging device according to the embodiment of the present invention.
Figure 19:
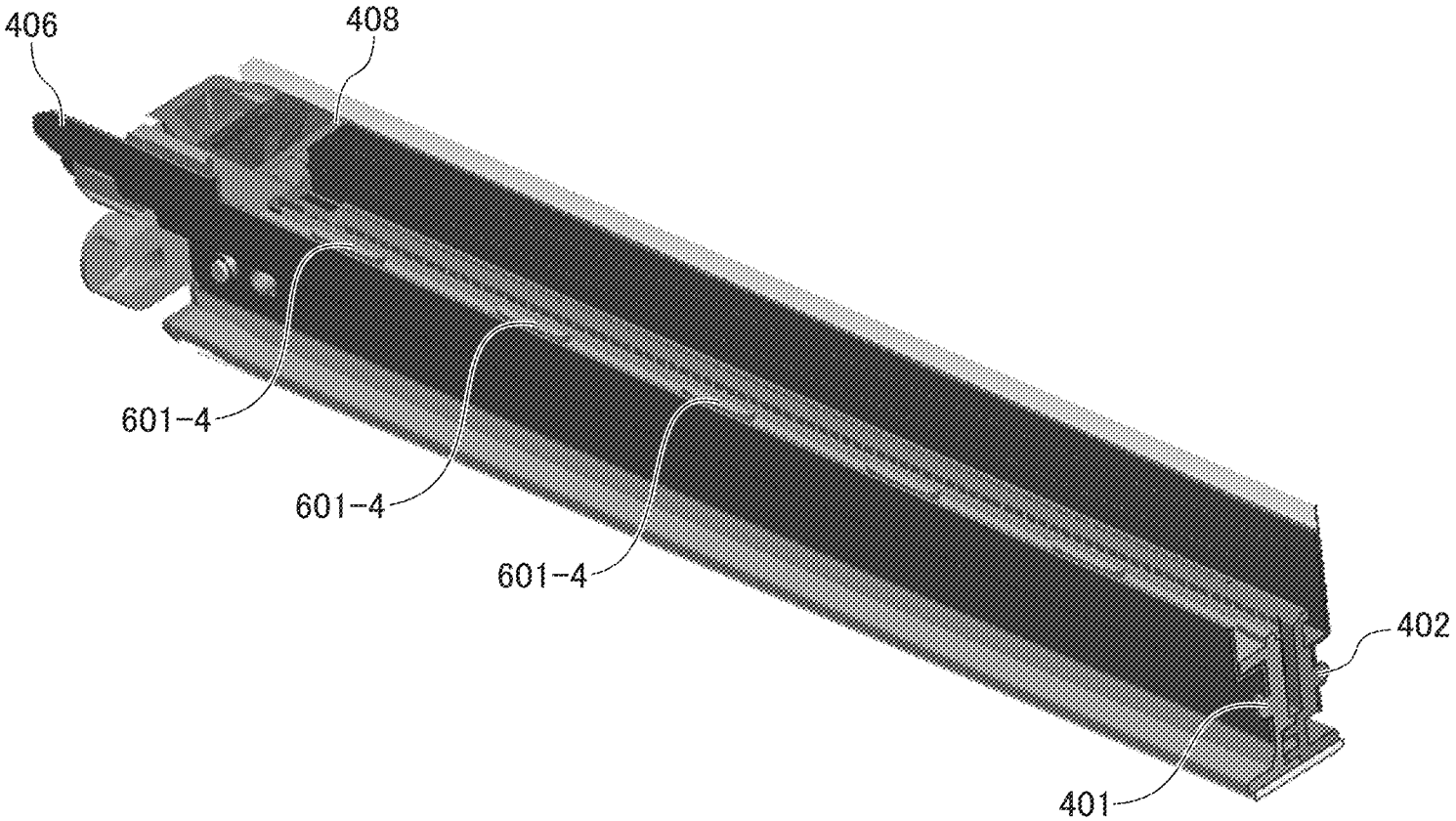
FIG. 19 is a perspective view illustrating the first discharging electrode retaining portion, the second discharging electrode retaining portion, a grid electrode, a shielding case plate, etc. of the charging device according to the embodiment of the present invention, as viewed from a viewpoint different from FIG. 12.

With reference to FIG. 8, the pair of moving-side rails 602 and 604 has a shape of a pair of guides. With reference to FIG. 15, the first fixed-side rail 601 provided to the first discharging electrode retaining portion 401 includes an upper side portion 601-1, an outer side portion 601-2, a lower side portion 601-3, and an inner side portion 601-4. In FIG. 15, these four portions appear to be integrated; however, actually, only part of the portions is integrated. Specifically, the upper side portion 601-1 and the outer side portion 601-2 appear to be integrated; however, as illustrated in FIGS. 2, 14, 16, 17 and 18, a plurality of these portions are discretely arranged along the longitudinal direction of the charging device 311. As illustrated in FIGS. 3, 18 and 19, the plurality of inner side portions 601-4 are discretely arranged along the longitudinal direction of the charging device 311, so as to synchronize with the upper side portions 601-1 and the outer side portions 601-2.

The outer side portions 601-2 and the inner side portions 601-4 interpose the guide-shaped first moving-side rail 602 with almost no gaps in the horizontal direction, thereby restricting the position of the first moving-side rail 602 with almost no backlash in the horizontal direction. Namely, the first moving-side rail 602 will proceed, while sliding, between the outer side portions 601-2 and the inner side portions 601-4 of the first fixed-side rail 601. Therefore, the rolling about the longitudinal axis of the MC cleaner bar 403 is prevented.

The lower side portions 601-3 are also arranged continuously or discretely along the longitudinal direction. The upper side portions 601-1 and the lower side portions 601-3 interpose the guide-shaped first moving-side rail 602 with a gap in the vertical direction; as a result, the upper side portions 601-1 and the lower side portions 601-3 of the first fixed-side rail 601 restrict the position of the first moving-side rail 602 with a backlash in the vertical direction.

Figure 20:
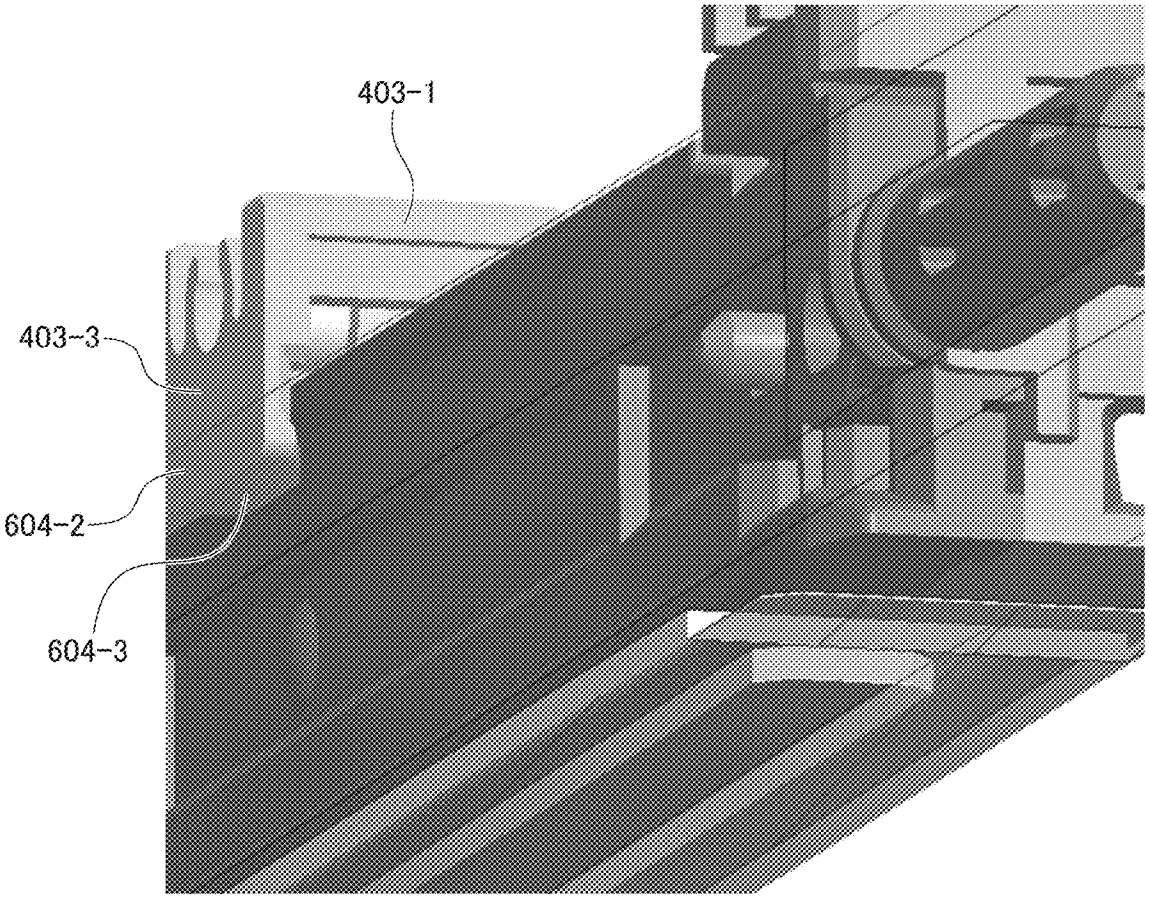
FIG. 20 is a perspective view illustrating a fixed-side rail and a moving-side rail to the right side in the travelling direction of the charging device according to the embodiment of the present invention.

As illustrated in FIG. 20, the second fixed-side rail 603 formed to the second discharging electrode retaining portion 402 restricts the right edge position of the second moving-side rail 604, in which the MC cleaner bar as being inserted into the charging device 311 is viewed in the direction from the insertion tip towards the insertion base; and the second fixed-side rail 603 restricts the position of the second moving-side rail 604 with a backlash in the vertical direction.

Therefore, the position of the MC cleaner bar 403 is restricted with almost no backlash in the vertical direction, and is restricted within a range in the vertical direction.

In the meantime, as described above, one or more of the nearest protruding portions 410-2 pierce the MC cleaner rubber 423. Therefore, the MC cleaner bar 403 would be pushed upwards by the protruding portions 410-2; however, with reference to the reference numbers depicted in, in particular, FIG. 15, the top surface of the first moving-side rail 602 formed to the MC cleaner bar 403 abuts on the under surface of the upper side portions 601-1 of the first fixed-side rail 601 formed to the first discharging electrode retaining portion 401; and the top surface of the lower side portions 604-3 of the second moving-side rail 604 formed to the MC cleaner bar 403 abuts on the under surface of the second fixed-side rail 603 formed to the second discharging electrode retaining portion 402; by virtue of the abutting at these two positions, the MC cleaner bar 403 will not move higher than a predetermined level. Therefore, the protruding portions 410-2 will forcibly pierce the MC cleaner rubber 423 into a predetermined depth. Further, since the level of the MC cleaner bar 403 will be restricted at a predetermined level in terms of both of the right and left in the horizontal direction, the rolling about the longitudinal axis of the MC cleaner bar 403 is prevented, at the abutting position of the top edge.

Next, a configuration including a raised portion according to the first embodiment of the present invention is described.

Figure 21:
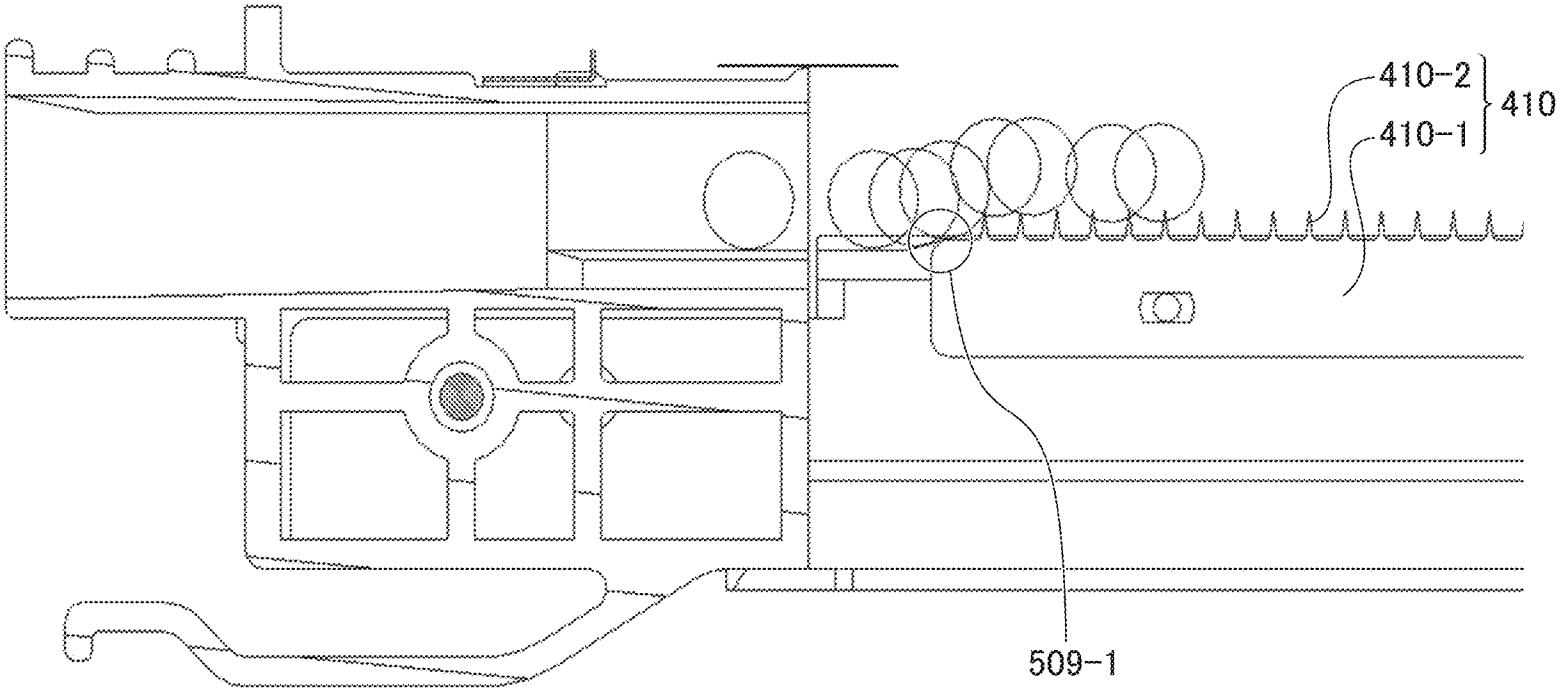
FIG. 21 is a schematic cross-sectional view illustrating an aspect, in which the MC cleaner rubber changes in height as it proceeds, and the protruding portions of the discharging electrode pierce the MC cleaner rubber, in the charging device according to the embodiment of the present invention.
Figure 22:
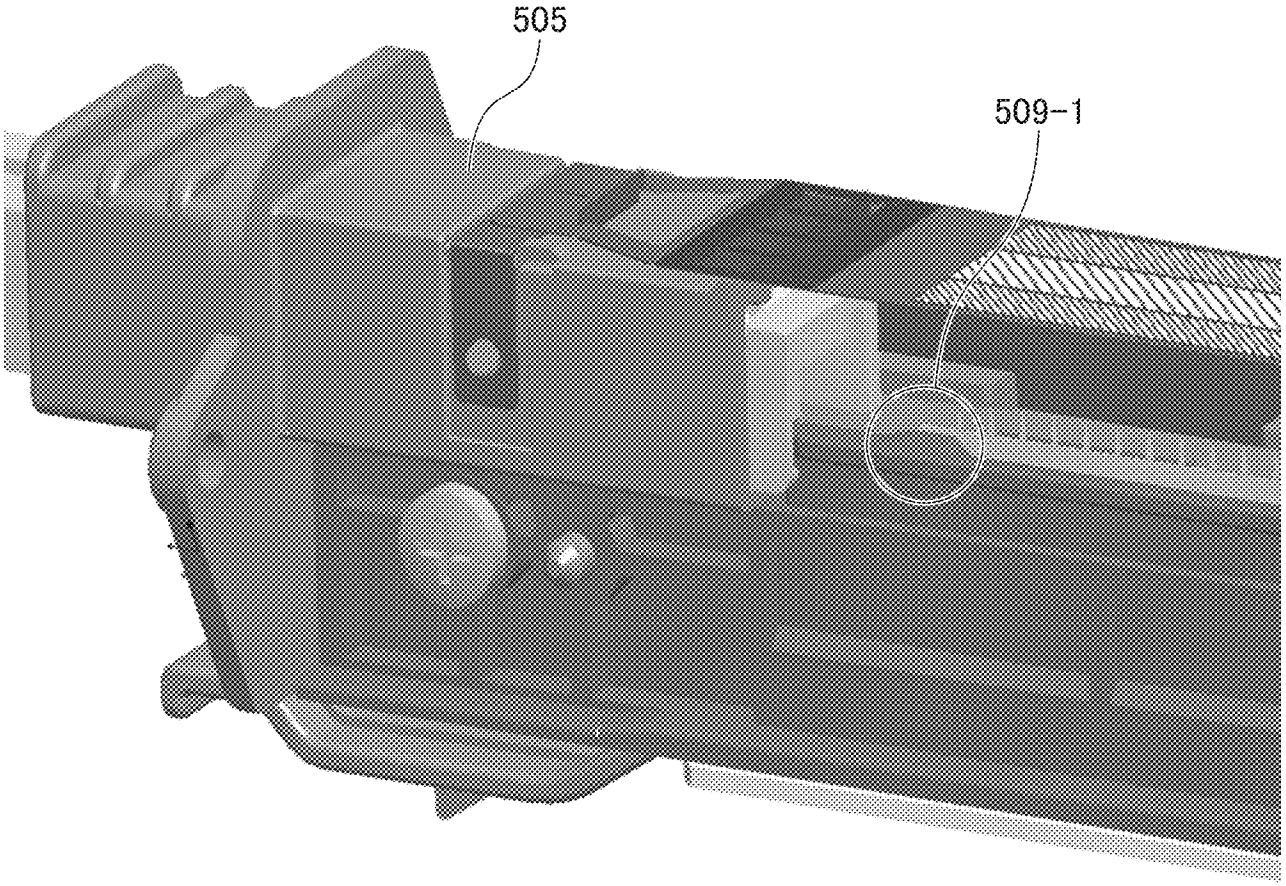
FIG. 22 is a perspective view mainly illustrating the fixed-side rail, the moving-side rail, as well as a raised portion, to the right side in the travelling direction, in the charging device according to the embodiment of the present invention.

In view of FIGS. 21 and 22, a raised portion 509 is arranged to a portion adjacent to the leftmost edge of the discharging electrode 410 (i.e. a portion immediately before the MC cleaner bar 403 as being inserted reaches the discharging electrode 410). In FIG. 22, etc., the raised portion 509 is formed by adjusting the level of the top surface of the second fixed-side rail 603; however, the raised portion 509 may be a portion such as a portion attached to the top surface of the second fixed-side rail 603. As illustrated in FIGS. 7, 9, 18, 21, 22, etc., until the tip portion of the MC cleaner bar 403 reaches the end portion of the front edge side of the discharging electrode 410 of the charging device 311 (the left side in FIG. 21), the MC cleaner rubber 423 of the MC cleaner 424 is in contact with the top surface of the second discharging electrode retaining portion 402 (a surface of which also serves as the top surface of the second fixed-side rail 603), in which the MC cleaner shaft portion 405-1 is passed through the bearing 511 arranged in the vicinity of the tip of the MC cleaner bar 403, as a result, the MC cleaner 424, while rotating, proceeds on the surface. In addition, in the vicinity of the raised portion 509, this top surface is raised upwards. As illustrated in FIG. 21, the MC cleaner 424 reaches the discharging electrode 410, while being raised along the raised portion.

Hypothetically, if the raised portion 509 is not provided, the MC cleaner 424 would directly hit the vicinity of the base of one or more of the protruding portions 410-2 arranged at the head of the discharging electrode 410, as a result, the protruding portions 410-2 being directly hit would be damaged or deteriorated at an early stage. Moreover, if the protruding portions 410-2 in the vicinity of the head are damaged or deteriorated at an early stage, the situation is substantially equal to having none of the protruding portions 410-2, and therefore, the protruding portions 410-2 following behind the MC cleaner bar 403 in the travelling direction (from the right side in FIG. 21) would also be directly hit by the MC cleaner 424, and damaged or deteriorated at an early stage, as in a chain reaction.

In contrast, since the raised portion 509 is provided in the first embodiment, the MC cleaner 424 abuts only on a region in the vicinity of the tip (namely, the vicinity of the upper end) of one or more of the protruding portions 410-2 arranged at the head of the discharging electrode 410; therefore, the protruding portions 410-2 can be prevented from being damaged or deteriorated at an early stage. A level, an angle of inclination and/or distribution of the raised portion 509-1 are adjusted and formed as follows. Namely, a level, an angle of inclination and/or distribution of the raised portion 509-1 are adjusted and formed, such that the MC cleaner 424 can reach the protruding portions 410-2 in the vicinity of the entrance, with a positional relationship that is similar to the positional relationship in the height direction maintained between the MC cleaner 424 and the protruding portions 410-2, in the central portion in the longitudinal direction of the discharging electrode 410. For example, the raised portion 509-1 is formed in a sloped shape that gently changes (for example, the angle of inclination changes in a sigmoid manner).

Therefore, when cleaning the discharging electrode 410, the entirety of the plurality of protruding portions 410-2 provided to the discharging electrode 410 can be protected, only by arranging the raised portion 509-1 to the portion adjacent to the leftmost edge of the discharging electrode 410 (i.e. a portion immediately before the MC cleaner bar 403 as being inserted reaches the discharging electrode 410) in view of FIGS. 21 and 22.

Figure 23:
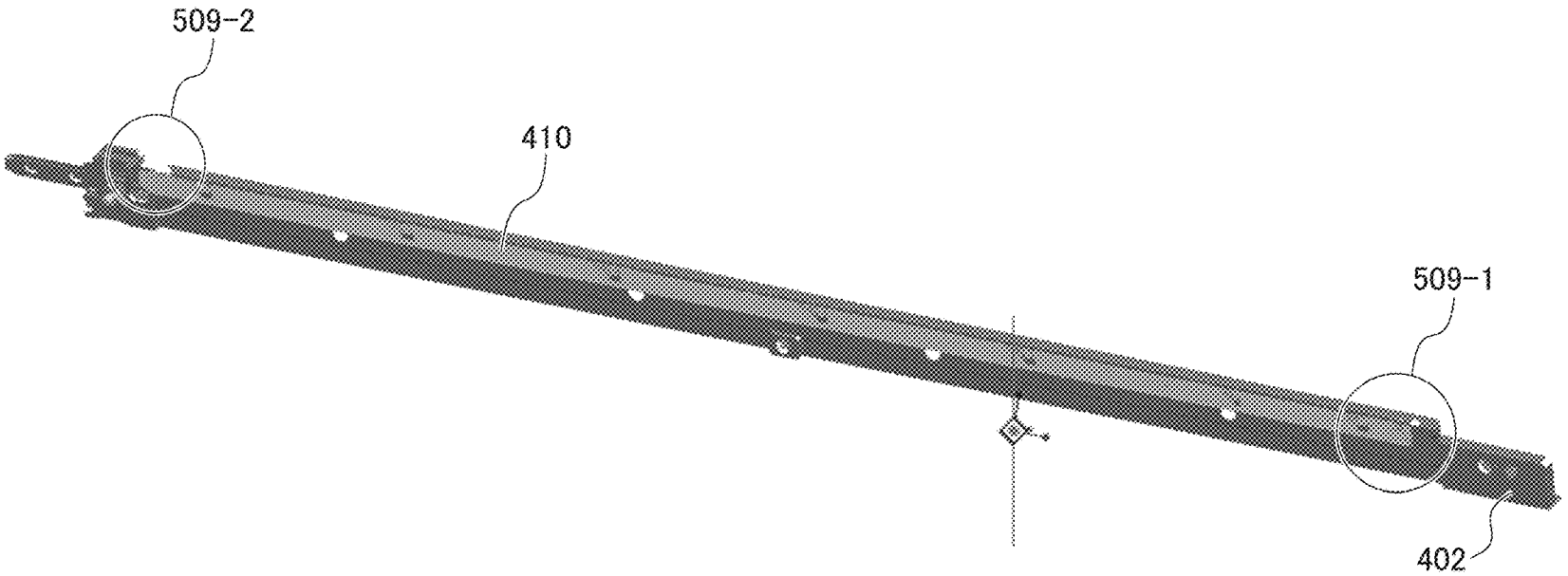
FIG. 23 is a perspective view illustrating the second discharging electrode retaining portion and the discharging electrode provided to the charging device according to the embodiment of the present invention.

Moreover, the MC cleaner 424 may proceed farther after cleaning the protruding portion 410-2 at the tail portion. In this case, in order to prevent the protruding portion 410-2 at the tail portion from being damaged or deteriorated at an early stage when the MC cleaner 424 is returned to the entrance, as illustrated in FIGS. 23 and 24, a raised portion 509-2 similar to the raised portion 509-1 is arranged to a portion adjacent to the rightmost edge of the discharging electrode 410 (i.e. a portion immediately before the MC cleaner bar 403 as being removed returns to the discharging electrode 410).

Figure 25:
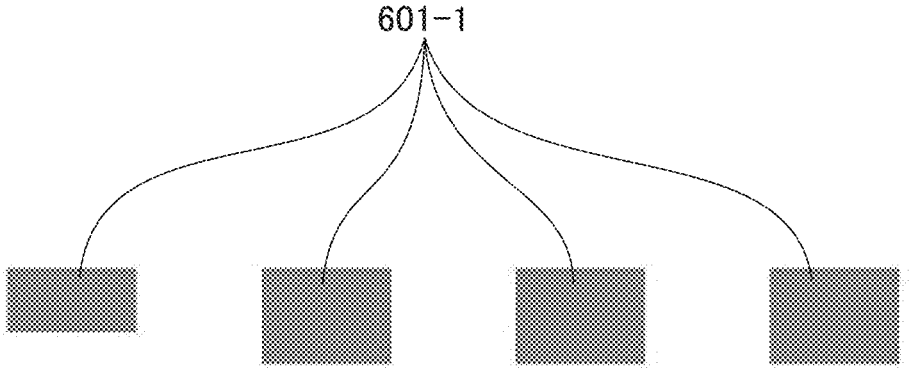
FIG. 25 is a schematic diagram illustrating an upper side portion of a first fixed-side rail 601 of the charging device according to the embodiment of the present invention.

Note that, as illustrated in FIG. 25, the level of the under surface of the upper side portion 601-1 of the fixed-side rail 601 may be constant without depending on the longitudinal position, but may be adjusted in accordance with the MC cleaner bar 403 vertically moved by way of the raised portion 509-1. Namely, the position of the MC cleaner bar 403 may be higher at a position in the longitudinal direction in which the raised portion 509-1 exists, and the MC cleaner 424 needs to be completely avoided from being interposed between the raised portion 509-1 and the under surface of the upper side portion 601-1 of the fixed-side rail 601; therefore, the level of the under surface of the upper side portion 601-1 of the fixed-side rail 601 may be set slightly higher than the level of the other portions, in consideration of the degree of insertion of the protruding portion 410-2 into the MC cleaner rubber 423.

Moreover, as illustrated in FIG. 12, a mechanism as described above determines the position or range of the tip portion of the MC cleaner bar 403 in the horizontal and vertical directions towards the travelling direction. In addition, in the portion where the MC cleaner bar 403 is surrounded by the entrance frame portion 505, the entrance frame portion 505 determines the position or range in the horizontal and vertical directions towards the travelling direction of the MC cleaner bar 403. Therefore, in view of the travelling direction of the MC cleaner bar 403 as a reference, the yawing and pitching of the MC cleaner bar 403 can be avoided.

Figure 24:
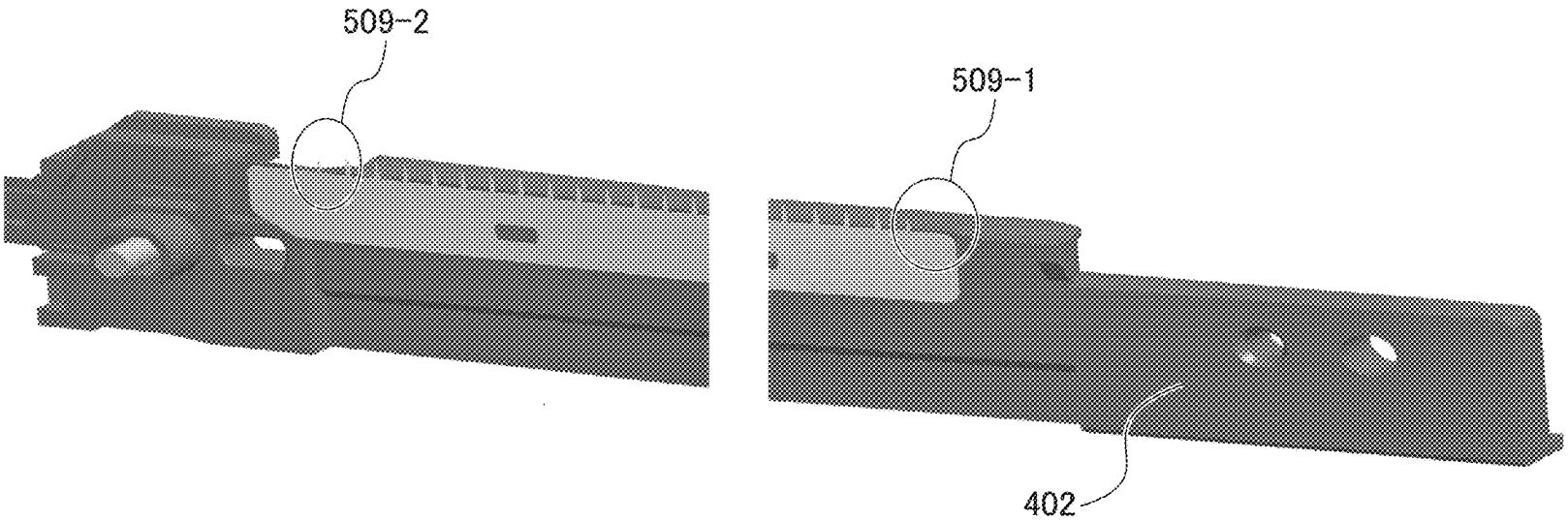
FIG. 24 is a partial enlarged view illustrating a vicinity of both ends of the second discharging electrode retaining portion and the discharging electrode illustrated in FIG. 23.

Note that a screw axis of a lead screw is illustrated in FIGS. 4 and 7; and an axis for power transmission is illustrated in the left end portion of FIG. 24. When the axis for power transmission rotates by way of power, the screw axis also rotates via a gear (not shown), and as a result, a nut (not shown) of the lead screw moves in the longitudinal direction. By coupling the MC cleaner bar 403 to this nut, and moving the MC cleaner bar 403 in the longitudinal direction by way of power, the discharging electrode can be automatically cleaned as well.

Second Embodiment

In the first embodiment, the second fixed-side rail 603 is continuously arranged in the longitudinal direction, while the first fixed-side rail 601 is discretely arranged in the longitudinal direction.

In contrast, in the second embodiment, the first fixed-side rail 601 is continuously arranged in the longitudinal direction, similar to the second fixed-side rail 603 (illustration is omitted herein).

Such a configuration further stabilizes the movement of the moving-side rail 602 and the moving-side rail 604, which correspond to the first fixed-side rail 601 and the second fixed-side rail 603, respectively; thereby allowing the MC cleaner bar 403 to move further stably in the longitudinal direction.

Third Embodiment

In the first embodiment, the first fixed-side rail 601 is discretely arranged in the longitudinal direction, while the second fixed-side rail 603 is continuously arranged in the longitudinal direction.

In contrast, in the third embodiment, the second fixed-side rail 603 is discretely arranged in the longitudinal direction, similar to the first fixed-side rail 601 (illustration is omitted herein).

Such a configuration allows the first fixed-side rail 601 and the second fixed-side rail 603 to be formed with high accuracy, even in a simple manufacturing process.

INDUSTRIAL APPLICABILITY

The present invention can be utilized for an electrophotographic image forming apparatus.

EXPLANATION OF REFERENCE NUMERALS

100: image forming apparatus
30: image forming portion
31 (31Y to 31B): process cartridge
310: photosensitive drum
311: charging device (charging unit)
312: developing device
313: cleaner unit
401: first discharging electrode retaining portion
402: second discharging electrode retaining portion
403: MC cleaner bar
405: MC cleaner main body
405-1: MC cleaner shaft portion
405-2: MC cleaner wheel portion
410: discharging electrode
410-1: main body portion (part of the discharging electrode)
410-2: protruding portion (another part of the discharging electrode)

423: MC cleaner rubber
424: MC cleaner
505: entrance frame portion
509-1, 509-2: raised portion
511: bearing (conforming to the MC cleaner shaft portion)
601: first fixed-side rail
602: first moving-side rail
603: second fixed-side rail
604: second moving-side rail

What is claimed is:

1. A charging device, comprising:

a discharging electrode including a plurality of protruding portions arranged along a predetermined direction and protruding in a protruding direction, the discharging electrode discharging electricity from at least part of the protruding portions;

a cleaner for cleaning at least some protruding portions included in the plurality of protruding portions;

a cleaner conveyance mechanism for conveying the cleaner along the predetermined direction for performing the cleaning, such that the cleaner interferes with at least some protruding portions included in the plurality of protruding portions; and a cleaner height adjustment mechanism for adjusting a height of the cleaner, when conveyed along the predetermined direction, in a vicinity of the protruding portion, such that at a first position where the cleaner is before the cleaner height adjustment mechanism, the cleaner is at a first level in a vicinity of a lower end of the protruding portion, and, at a second position where the cleaner is on the cleaner height adjustment mechanism, the cleaner is at a second level in a vicinity of an upper end of the protruding portion, the first level being lower in the protruding direction than the second level.

2. The charging device according to claim 1, wherein the cleaner height adjustment mechanism is configured such that a height of a lower end portion of the cleaner, in the vicinity of the protruding portion where the cleaner reaches at first, is proximate to a height of a vicinity of a tip portion of the protruding portions.

3. The charging device according to claim 1, wherein the cleaner height adjustment mechanism includes a raised portion arranged immediately before the protruding portion where the cleaner reaches at first;

and wherein the cleaner rides on the raised portion immediately before the protruding portion where the cleaner reaches at first.

4. The charging device according to claim 3, wherein the raised portion is shaped like a slope.

5. The charging device according to claim 1, wherein the cleaner height adjustment mechanism is provided in a vicinity of both ends or one end of the discharging electrode.

6. The charging device according to claim 1, wherein the cleaner conveyance mechanism comprises:

a cleaner holder to which the cleaner is rotatably attached; and a slide rail for supporting the cleaner holder so as to allow a height of the cleaner to be adjusted, and conveying the cleaner holder along the predetermined direction.

7. The charging device according to claim 6, wherein the slide rail is configured such that a height of the cleaner holder can be adjusted within a predetermined range in relation to a reference position of the slide rail.

8. The charging device according to claim 6, wherein the slide rail is configured such that a position of the cleaner holder in a vertical direction to the predetermined direction is restricted in relation to a reference position of the slide rail.

9. The charging device according to claim 6, wherein the slide rail is configured so as to prevent rolling of the cleaner holder about the predetermined direction being regarded as an axial direction.

10. The charging device according to claim 6, wherein the slide rail comprises a first slide rail and a second slide rail;

the first slide rail comprises:

a first moving-side rail provided to the cleaner holder; and a first fixed-side rail provided to a discharging electrode retaining portion for holding the discharging electrode; and the second slide rail comprises:

a second moving-side rail provided to the cleaner holder; and a second fixed-side rail provided to the discharging electrode retaining portion.

11. The charging device according to claim 10, wherein the cleaner is rotatably attached to a region in a vicinity of a tip portion of the cleaner holder;

the first moving-side rail and the second moving-side rail are both shaped like a guide formed in the vicinity of the tip portion of the cleaner holder;

at least the plurality of first fixed-side rails are discretely formed along the predetermined direction; and the plurality of fixed-side rails, being discretely formed, guide the corresponding moving-side rail.

12. The charging device according to claim 10, wherein the cleaner is rotatably attached to a region in a vicinity of a tip portion of the cleaner holder;

the first moving-side rail and the second moving-side rail are both shaped like a guide formed in the vicinity of the tip portion of the cleaner holder;

at least the second fixed-side rail is continuously formed along the predetermined direction; and at least the second fixed-side rail, being continuously formed, guides the corresponding moving-side rail.

13. The charging device according to claim 10, further comprising a frame portion for surrounding the cleaner holder with an entrance; wherein the cleaner holder and the frame portion surrounding the cleaner holder at the entrance form a third slide rail; and at least one of the first and second slide rails, and the third slide rail, are configured such that pitching and yawing of the cleaner holder are prevented with respect to the conveyance direction being regarded as an axis.

14. The charging device according to claim 13, wherein the cleaner holder is a bar-like cleaner holder that extends in the predetermined direction.

15. The charging device according to claim 6, wherein the cleaner holder is a bar-like cleaner holder that extends in the predetermined direction.

16. An image forming unit, comprising:

a photosensitive drum as an image carrier;

a charging unit for charging the photosensitive drum;

a developing unit for developing an electrostatic latent image formed on the photosensitive drum into a toner image; and a cleaner unit for removing a toner remaining on a surface of the photosensitive drum;

wherein the charging device according to claim 1 is used as the charging unit.

17. An image forming apparatus, comprising:

a photosensitive drum as an image carrier;

a charging unit for charging the photosensitive drum;

an exposing unit for forming a latent image on the photosensitive drum;

a developing unit for developing an electrostatic latent image formed on the photosensitive drum into a toner image; and means configured to form the toner image on a recording medium; and a cleaner unit for removing a toner remaining on a surface of the photosensitive drum;

wherein the charging device according to claim 1 is used as the charging unit.

18. The image forming apparatus according to claim 17, further comprising transporting means configured to convey the recording medium.

* * * * *